US009033753B2

(12) United States Patent
Siverts et al.

(10) Patent No.: US 9,033,753 B2
(45) Date of Patent: May 19, 2015

(54) SAIL-EQUIPPED PADDLE FOR STAND-UP PADDLE BOARDS

(71) Applicants: Curt Siverts, Redondo Beach, CA (US); Hanson Siverts, Redondo Beach, CA (US)

(72) Inventors: Curt Siverts, Redondo Beach, CA (US); Hanson Siverts, Redondo Beach, CA (US)

( * ) Notice: Subject to any disclaimer, the term of this patent is extended or adjusted under 35 U.S.C. 154(b) by 59 days.

(21) Appl. No.: 13/869,020

(22) Filed: Apr. 23, 2013

(65) Prior Publication Data

US 2013/0340661 A1 Dec. 26, 2013

Related U.S. Application Data

(60) Provisional application No. 61/802,242, filed on Mar. 15, 2013, provisional application No. 61/688,837, filed on May 22, 2012, provisional application No. 61/687,279, filed on Apr. 23, 2012.

(51) Int. Cl.

| | |
|---|---|
| ***B63H 16/04*** | (2006.01) |
| ***B63H 9/00*** | (2006.01) |
| ***B63H 9/04*** | (2006.01) |
| ***B63B 35/79*** | (2006.01) |

(52) U.S. Cl.

CPC ..... *B63H 9/04* (2013.01); *B63B 35/7959* (2013.01); *B63B 35/7973* (2013.01); *B63H 16/04* (2013.01)

(58) Field of Classification Search

CPC ..... B63H 2009/088; B63H 9/1035; B63H 9/1042; B63H 9/04; B63H 9/06; B63H 35/795; B63H 35/7973

USPC ..... 440/101–110; 114/104–107, 39.22, 114/39.11

See application file for complete search history.

(56) References Cited

U.S. PATENT DOCUMENTS

| | | | |
|---|---|---|---|
| 302,517 | A | 7/1884 | Nelson |
| 1,859,178 | A | 5/1932 | Sprinkle |
| 2,793,870 | A | 5/1957 | Bowman |
| 3,529,907 | A | 9/1970 | Akermanis |
| 3,768,823 | A | 10/1973 | Goldberg |

(Continued)

FOREIGN PATENT DOCUMENTS

| | | |
|---|---|---|
| CN | 102874396 | 1/2013 |
| GB | 2201389 | 1/1988 |
| WO | 2013/163235 | 10/2013 |

OTHER PUBLICATIONS

PCT International Search Report for PCT/US2013/037870 (published as WO 2013/163235), which is the corresponding PCT Application of U.S. Appl. No. 13/869,020.

(Continued)

*Primary Examiner* — S. Joseph Morano
*Assistant Examiner* — Andrew Polay
(74) *Attorney, Agent, or Firm* — Richard B. Cates

(57) ABSTRACT

A paddle for stand-up paddle boards includes a paddle blade at a lower end of the paddle shaft and a sail assembly slidingly stowed within the shaft, with the sail deployed by sliding the sail assembly distally out of the shaft upper end. The sail assembly may include a sail and support frame. A method and system for transporting a user across water or other surfaces has a board for the user to stand upon and a paddle with sail slidingly deployed from inside a paddle shaft via an opening in the upper end. To propel via paddling, the user leaves the sail stowed within the shaft. The propel via wind, the user deploys the sail out of the shaft, places the blade onto the board upper surface, and angles the paddle and sail to catch the wind and propel the user across the water.

20 Claims, 25 Drawing Sheets

(56) References Cited

U.S. PATENT DOCUMENTS

| | | | | | |
|---|---|---|---|---|---|
| 3,858,542 | A | * | 1/1975 | Lenoble | 114/102.11 |
| 3,924,870 | A | | 12/1975 | Spivack et al. | |
| 4,136,631 | A | | 1/1979 | Nimchuk | |
| 4,269,133 | A | | 5/1981 | Brown | |
| 4,311,324 | A | | 1/1982 | Fries | |
| 4,531,763 | A | | 7/1985 | Toland | |
| 4,651,665 | A | | 3/1987 | Drake | |
| 4,653,416 | A | | 3/1987 | Debarge | |
| 4,756,555 | A | | 7/1988 | Bachmann | |
| 4,810,217 | A | | 3/1989 | Bell | |
| 4,926,772 | A | | 5/1990 | Bright | |
| 5,074,815 | A | * | 12/1991 | Gibson | 440/101 |
| 5,163,778 | A | | 11/1992 | Botero | |
| 5,372,081 | A | | 12/1994 | Mayer | |
| 5,476,058 | A | | 12/1995 | Wilson | |
| 6,022,255 | A | * | 2/2000 | Lukanovich | 440/101 |
| 6,986,318 | B2 | * | 1/2006 | Sawyer | 114/102.1 |
| 7,350,474 | B2 | | 4/2008 | Horiuchi | |
| D590,324 | S | | 4/2009 | Marvin et al. | |
| 7,726,694 | B2 | | 6/2010 | Guillot | |
| 2003/0106479 | A1 | | 6/2003 | Suh | |
| 2005/0045085 | A1 | | 3/2005 | Sawyer | |
| 2012/0049502 | A1 | | 3/2012 | Ascunce | |
| 2012/0318183 | A1 | * | 12/2012 | Chen | 114/39.22 |

OTHER PUBLICATIONS

PCT Search History for PCT/US2013/037870 (published as WO 2013/163235), which is the corresponding PCT Application of U.S. Appl. No. 13/869,020.

PCT Written Opinion of the International Searching Authority for PCT/US2013/037870 (published as WO 2013/163235), which is the corresponding PCT Application of U.S. Appl. No. 13/869,020.

* cited by examiner 122
130

122
6F
50
120

130
122

130
6D
50
122
120

124
122
6B
6B
50
120

126
128

SAIL-EQUIPPED PADDLE FOR STAND-UP PADDLE BOARDS

RELATED APPLICATIONS

The current application claims priority from U.S. Provisional Patent Application No. 61/802,242, filed Mar. 15, 2013, and entitled "Sail Paddle for Stand Up Paddle Boards", and also from U.S. Provisional Patent Application No. 61/688,837, filed May 22, 2012 and entitled "Sail Paddle for Stand Up Paddle Boards", and also from U.S. Provisional Patent Application No. 61/687,279, filed Apr. 23, 2012 and entitled "Sail Paddle for Stand Up Paddle Boards", the entire contents of each of which are incorporated herein by reference.

FIELD OF THE INVENTION

The present invention relates to the field of standup paddle boards, where a person stands on a paddle board and propels himself/herself through the water using a relatively long paddle via a paddling motion and/or, with the current invention, via wind power.

BACKGROUND OF THE INVENTION

Paddle boarding is a sport where a relatively large and buoyant surfboard-like board is used, with a user standing on the board and paddling using a paddle having a relatively long shaft with a blade at one end, and often a handle at the other. The relatively long shaft permits the user to dip the blade into the water from a standing position in order to drive the board forward via the blade engaging the water.

A user can stand on the SUP board and paddle with the long-shafted paddle. The user can paddle the board over relatively flat water and, depending on the strength and skill of the user, in relatively rough water. Skilled SUP boarders can even use the paddle and board to surf waves.

Paddle boards permit the user to paddle across relatively long distances with relatively little resistance from the water due to the relatively small displacement of the SUP board. However, due to the relatively large cross-sectional area presented by a user's body when in the standing position, wind conditions can have a major impact on the user's ability to paddle the board through the water. Users may paddle to a desired destination, and then be relatively tired for the return journey back to their starting point. In windy conditions, the user may have great difficulty in advancing the board through the water, especially if the user is already tired from an outbound journey and is presented by a headwind on the return journey.

SUMMARY OF THE INVENTION

The invention comprises systems, methods, and devices for stand-up paddle boarding, and more particularly for using the wind to power a stand-up paddle board or other conveyance. The invention may also be applicable to other types of transport, including so-called land paddles for use with skateboards and other wheeled transport.

In an embodiment of the invention, a stand-up paddle is provided which has a shaft having a proximal end and a distal end. A paddle blade is provided at the proximal end. A sail assembly is slidingly disposed within an inner lumen of the shaft, and is configured to be slidingly deployed in telescoping relation out of an opening in the distal end of the shaft. The opening may be positioned in a handle, such as a substantially T-shaped handle, positioned at the distal end of the shaft. The opening may include a substantially funnel-shaped portion configured to guide the sail assembly into the shaft inner lumen when the user slidingly stows the sail assembly into the shaft. When the sail assembly is stowed within the paddle shaft, the paddle may have the same overall appearance and performance as a standard (i.e., non-sail-equipped) SUP paddle.

A sail assembly according to an embodiment of the invention may comprise a sail and a sail support structure. The sail and sail support structure may be of various shapes and configuration, depending on the particular embodiment. In one embodiment, the sail support structure comprises a mast and boom, with the mast in the deployed configuration extending distally from the distal end of the paddle shaft and in substantially longitudinal alignment therewith, while the boom extends laterally from the mast. The boom may extend from the mast at an angle between 60 and 12 degrees, or in a substantially perpendicular manner, such as at an angle of (or of about) 90 degrees from the mast. The boom may join the mast at a point at or adjacent the distal end of the paddle shaft when the sail assembly is in the deployed configuration. The sail may have an upper portion, which may be substantially triangular in shape, extending between the boom and mast. The sail may have a lower portion, which may be substantially triangular in shape, extending between the boom and paddle shaft.

When the SUP boarder has the sail assembly deployed and is sailing with the SUP board, the paddle blade may be set against the board top surface. The paddle blade may also be used for maneuvering/guiding the board by holding the blade in the water (e.g., on the downwind or upwind side of the board) to act as rudder and/or keel in guiding the board.

In one embodiment of the invention, a system for paddle boarding comprises a paddle board and a paddle. The paddle includes a paddle shaft having a paddle blade on a proximal end of the paddle shaft and a sail assembly configured to slidingly and telescopically extend from the distal end of the paddle shaft. The paddle board may include a multi-slotted paddle blade holder having slots configured to receive the lower edge of the paddle blade, with the slots sized to receive the paddle blade and to prevent rotational movement (about the longitudinal axis defined by the paddle shaft) of the paddle blade with respect to the SUP board.

In a further embodiment of the invention, a sail assembly and upper paddle shaft portion (including paddle handle) are sold or otherwise provided as a retrofitting kit to retrofit an existing adjustable-length SUP paddle, wherein the existing adjustable-length paddle has a previously-provided lower paddle shaft having a paddle blade at the proximal end thereof, and a previously-provided upper paddle shaft portion having a paddle handle at the distal end thereof, wherein the previously-provided upper paddle shaft is configured to slide within the previously-provided lower paddle shaft in order to adjust the overall length of the paddle. A user can slidingly remove the previously-provided upper paddle shaft from the previously-provided lower paddle shaft, and replace it with the new sail-equipped upper paddle shaft, which may be dimensioned (e.g., having the same diameter and/or similar length as the previously-provided upper paddle shaft) to mate with the previously-provided lower paddle shaft in the same manner as the previously-provided upper paddle shaft. The user can replace the upper paddle shaft portion multiple times, including swapping out an upper paddle shaft having no sail with an upper paddle shaft having a sail, or swapping out an upper paddle shaft having a first sail of a first size and shape with an upper paddle shaft having a second sail having a different size and/or shape from the first sail.

A paddle according to an embodiment of the invention is a specially designed paddle for the growing sport of stand-up paddle boarding. It is a standup paddle that can convert to a standup sailing rig for allowing ease of movement by enabling the user to sail or move without paddling in certain directions (i.e. with the wind). It may also be used to sail by tacking and jibing into the wind. Everything that is needed to sail may be self-contained within the paddle's shaft/tubular body (which may be 4 to 6½ in length) with no external accessories or hardware needed.

A paddle of the invention may have an elongated paddle shaft having an internal lumen, a proximal end, a distal end, and distal opening at the distal end, with the distal opening leading to the internal lumen; a paddle blade secured to the proximal end of the paddle shaft; and a sail assembly comprising a sail and a collapsible support structure, wherein the sail assembly comprises a stored configuration and a deployed configuration, wherein in the stored configuration the support structure and sail assembly are slidingly stowed within the paddle shaft internal lumen, in the deployed configuration the support structure and sail extend outwardly from the paddle shaft distal end, and wherein the sail assembly transforms from the stored configuration to the deployed configuration by telescopically and slidingly extending from the distal opening of the elongated paddle shaft. The support structure may have a mast and a boom, with the mast comprises a mast proximal end and a mast distal end and the boom comprises a boom proximal end and a boom distal end, and wherein the boom proximal end is hingedly secured to the mast at a boom attachment point, and wherein the sail assembly has a deployed configuration and a stowed configuration, wherein in the stowed configuration the mast, boom, and sail are slidingly positioned within the paddle shaft internal lumen with the boom substantially parallel to the mast, wherein in the deployed configuration the sail, mast, and boom are positioned outside of the paddle shaft internal lumen with the boom substantially non-parallel to the mast, wherein the sail assembly transforms from the stowed configuration to the deployed configuration by hingedly rotating the boom to a substantially non-parallel orientation from the mast. The boom attachment point may be positioned at a proximal end of the mast and at a distal end of the paddle shaft when the sail assembly is in the deployed configuration. The mast may be positioned substantially in longitudinal alignment with the paddle shaft when the sail assembly is in the deployed configuration. The boom may be positioned substantially perpendicular to the mast when the sail assembly is in the deployed configuration. The paddle shaft may have a lower shaft portion to which the paddle blade is secured, an upper shaft portion, and a shaft locking mechanism, with the lower shaft portion and upper shaft portion telescopically and rotatably movable with respect to each other when the shaft locking mechanism is locked, and telescopically and/or rotatably locked with respect to each other when the shaft locking mechanism is locked. The sail may have a sail strap secured to the boom at a position closer to the distal end thereof than to the proximal end thereof (e.g., at or adjacent the distal end thereof) with the sail strap is sized and configured to permit a user to pass a hand therethrough to thereby grasp the sail strap. The strap may provide an opening from 3 to 8 inches in length for a user to pass his/her hand and/or fingers therethrough in order to grasp the strap/boom/sail. The paddle may include a sealing mechanism to prevent water form passing into the paddle shaft, which may be in the form of an O-ring at or adjacent a distal end of the mast, with the O-ring configured to seal the shaft distal opening when the mast, boom, and sail are slidingly positioned within the paddle shaft internal lumen in the stowed configuration.

An embodiment of the invention is a system for transport over water, with a stand up paddle board configured for a person to stand thereon; a paddle, wherein the paddle comprises a paddle shaft having a distal end and a proximal end, a paddle blade secured to the paddle shaft proximal end, and a sail assembly configured to slidingly and telescopically extend from and retract into the distal end of the paddle shaft. The system may have a pad positioned on an upper surface of the stand up paddle board, wherein the pad comprises one or more grooves on an upper surface thereof configured to receive a lower edge of the paddle blade. The pad may have at least 8 grooves, the grooves intersect at a single intersection point, and the grooves extend across the pad upper surface at different angles with respect to each other. The system may include a paddle blade engaging structure extending from a side of the paddle board, the structure configured to engage and secure the paddle blade to prevent rearward movement thereof with respect to the paddle board when the board is in water with the paddle blade positioned in the water against the structure. The paddle blade engaging structure may extend sideways from the side of the paddle board and forward with respect to the paddle board.

A method of traveling across the water surface on a paddle board according to an embodiment of the invention comprises: placing a paddle board in the water; holding a paddle in a hand of the user, wherein the paddle comprises a paddle shaft having a proximal and a distal end, wherein a paddle blade is secured to the proximal end and a sail assembly is slidingly disposed within the paddle shaft, wherein the user holds the paddle by the paddle shaft; the user standing on the upper surface of the paddle board; the user paddling the board by placing the paddle blade in the water and pushing against the water via the paddle blade; telescopically and slidingly extending the sail assembly out of the paddle shaft via the distal end of the shaft; unfolding the sail assembly to a deployed configuration; securing the sail assembly in the deployed configuration; sailing the paddle board by positioning the paddle and deployed sail assembly at a desired position with respect to the board to capture and/or redirect the wind to effectuate movement of the paddle board. After sailing the paddle board, the user can unsecure the sail assembly from the deployed configuration; fold the sail assembly from the deployed configuration; and slidingly and telescopically retract the sail assembly into the paddle shaft via the distal end of the shaft.

Sailing the paddle board may involve placing the paddle blade onto the top surface of the paddle board, and/or placing the paddle blade into the water along a side of the paddle board with the blade substantially parallel to, and/or angled from, the side of the paddle board. The paddle board may be steered by shifting the deployed sail to the right and/or left side of the paddle board.

The invention may also be used in connection with skate boards by replacing the paddle blade of the SUP paddle with a padded lower end, such as a rubber wheel-shaped end (which may be round or curved or of another shape), configured to engage a solid surface such as a road or sidewalk. Such a modified paddle becomes a so-called land paddle which an operator can use by pressing the lower end against the ground (e.g., sidewalks, roads, etc.) to push himself/herself along on a wheeled skateboard. In such an embodiment, the user can deploy the sail and place the padded lower end onto the skateboard upper surface, and let the wind drive the operator and skateboard along.

DETAILED DESCRIPTION OF PREFERRED EMBODIMENTS

Figure 1:
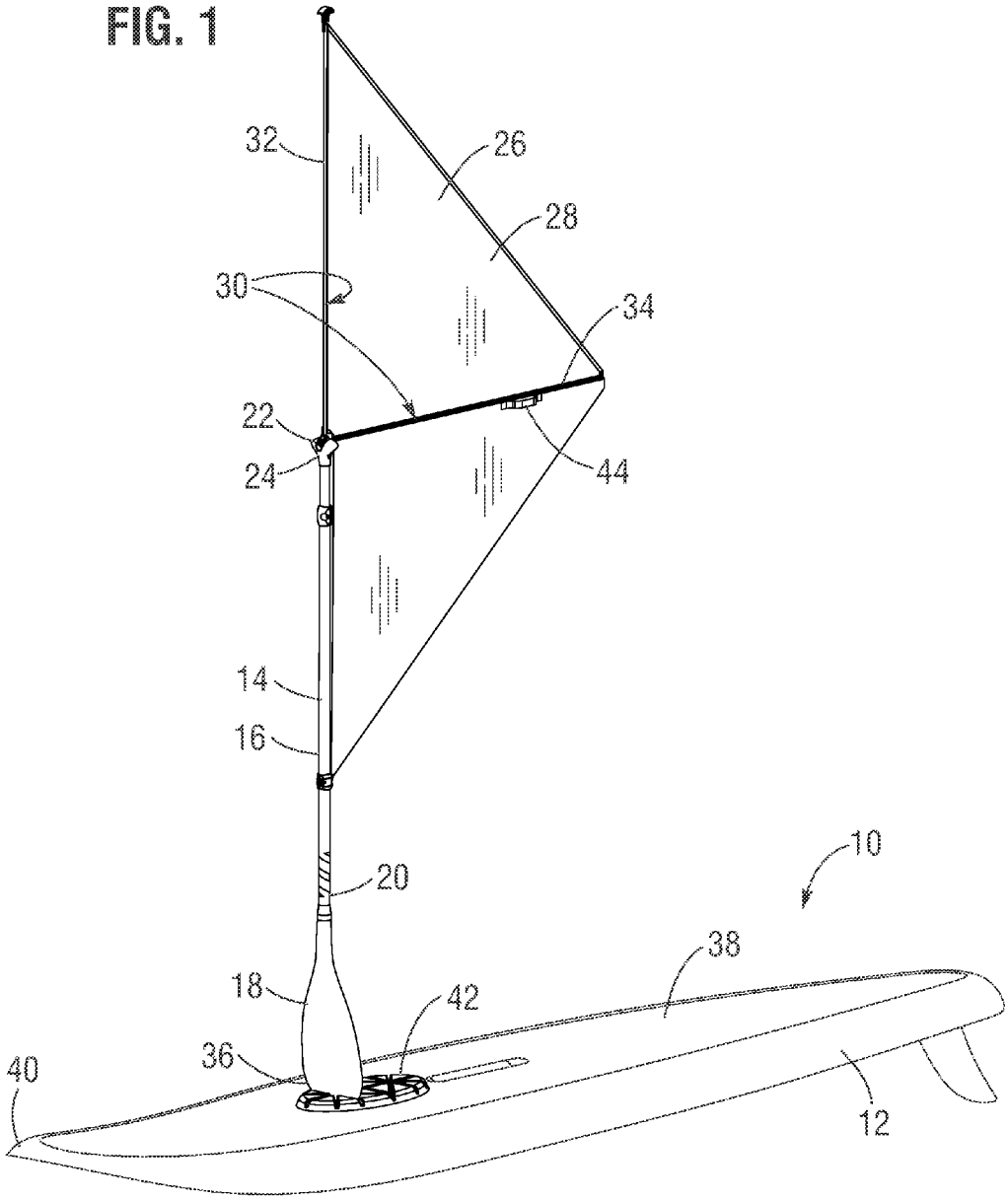
FIG. 1 depicts a perspective view of a system according to an embodiment of the invention.

A system 10 according to the invention is depicted in FIG. 1. The system comprises a stand-up paddle board 12 and a paddle 14. The paddle 14 includes a paddle shaft 16 having a paddle blade 18 at a proximal end 20 thereof, and a handle 22 at a distal end 24 thereof. A sail assembly 26 extends from the paddle shaft 16. The sail assembly 26 comprises a sail 28 and support structure 30, with the support structure comprising a mast 32 and boom 34. The paddle 14 can be used to paddle the SUP board 12 (preferably with the sail in a stowed configuration depicted in FIG. 2A below), or to sail the SUP board. To sail the SUP board 12, the user can stand on the SUP board 12 and place a lower edge 36 of the paddle blade 18 against the top surface 38 of the SUP board 12. The lower edge 36 of the paddle blade may be placed at a position toward the front end 40 of the SUP board 12. A paddle blade holder 42 may be positioned on the SUP board top surface 38 at a desired position where the paddle blade lower edge 36 is intended to be positioned. The user can grasp the paddle 14 by the shaft 16 and/or by the sail assembly 26, such as by grasping one or more of the sail straps 44. Note that the sail straps may be secured to the sail (as via thread), to the boom, and/or both the sail and the boom.

Figure 2A:
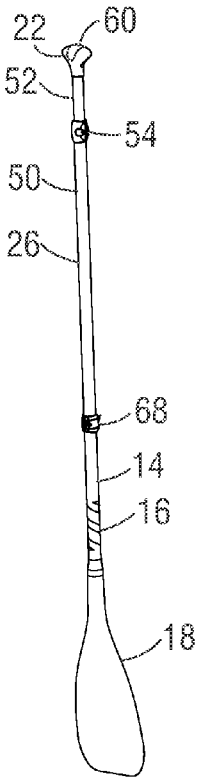
FIGS. 2A-2C depict perspective views, with sail assembly in stowed, being deployed, and fully deployed, respectively, of a paddle according to an embodiment of the invention.
Figure 2B:
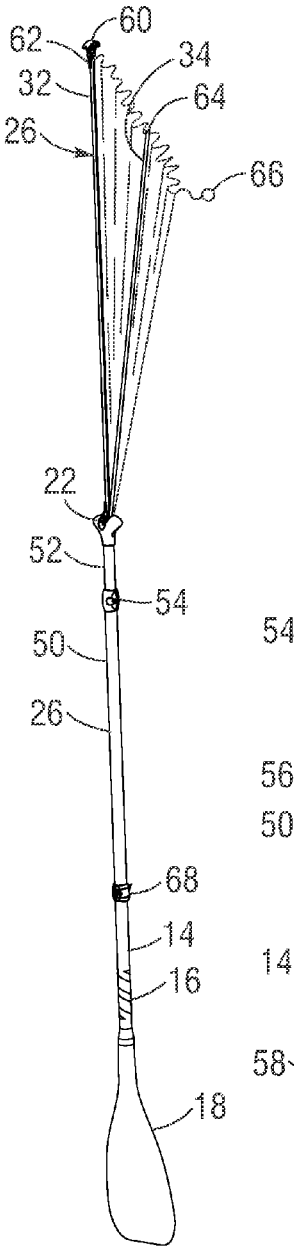
Figure 2C:
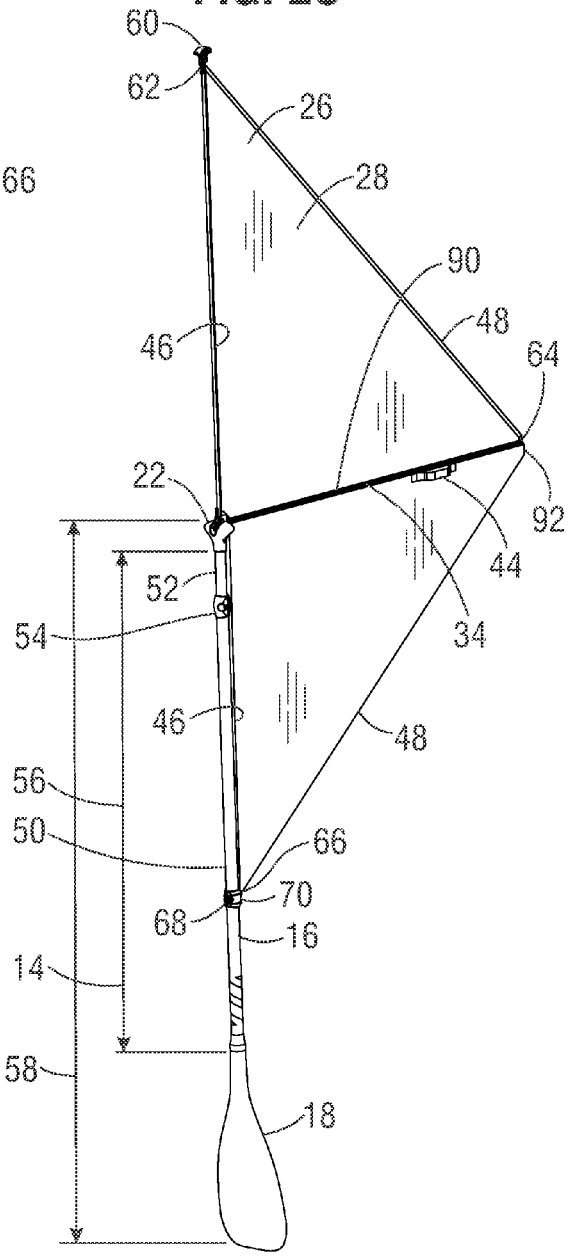

The sail assembly can be stowed inside the paddle shaft 16 (as depicted in FIG. 2A below) for regular paddling, and can be extended (as depicted in FIGS. 1 and 2B-2C) from inside the paddle shaft's tubular body 16 and unfolded to set the sail 28 into certain directions. The operator holds the paddle 14 by the shaft tubular body 16 and/or the sail assembly 26 (e.g., via the boom 34 and/or the sail 28) thus allowing the sail to be high enough to catch the wind and permit the operator to sail in a designated direction. To change the direction of sail, the operator rotates the sail assembly to a desired position (e.g., by rotating the entire paddle) to achieve the desired direction of travel. If the wind dies, or the wind direction is not conducive to the desired direction of travel, or the operator simply wants to paddle normally, the sail assembly 26 can be stowed by sliding the sail assembly 26 back into the paddle shaft 16.

The paddle 14 has stowed and deployed configurations, as depicted in FIGS. 2A-2C. In FIG. 2A, the sail assembly is in the stowed configuration and thus not visible, and the paddle 14 looks and operates like a standard SUP paddle. In the particular embodiment depicted, the paddle shaft 16 is formed from two portions, a lower portion 50 and an upper portion 52, with the upper portion 52 configured to slide within the lower portion 50 when a locking mechanism 54 is unlocked to permit the sliding action in order to adjust the shaft length 56 and thus the overall paddle length 58 from blade tip to handle. When the desired shaft length is achieved, the locking mechanism 54, which may be a standard compressive locking fitting (e.g., operated by moving a lever or rotating the entire lock) such as those known in the art, may be returned to the locked position to prevent further sliding of the upper portion 52 with respect to the lower portion 50 and thus maintain the desired shaft length 56.

As depicted in FIG. 2B, with the sail assembly 26 can be slidingly deployed in a substantially telescoping manner from the paddle shaft 16 by pulling on the sail assembly cap 60, which is secured to the mast distal end 62 and, when the sail assembly 26 is stowed, is positioned snuggly within the top of the paddle handle 22. When initially slid out of the paddle shaft 16, the mast 32 and boom 34 are substantially parallel to each other and also in longitudinal alignment with the paddle shaft 16. When the sail assembly 26 is slid out to its maximum position from within the paddle shaft 16, the mast 32 is still held in substantial alignment with the paddle shaft 16, while the boom 34 can rotate with the boom distal end 64 rotating downward and away from the mast distal end 59. The sail assembly comprises a lower sail loop 66 which acts as a downhaul for the sail 28. As the sail assembly 26 is deployed and the boom 34 is lowered, the operator can secure the lower sail loop 66 to a lower portion of the paddle 14, such as via the downhaul lock sleeve 68 which, in the embodiment depicted, includes a downwardly-directed hook 70 configured to receive and hold the lower sail loop 62. Once the lower sail loop 66 is secured to the downhaul lock sleeve 68, the downhaul lock sleeve 68 can be unlocked to permit it to slide. The user can slide the (unlocked) downhaul lock sleeve downward to tighten/stretch the sail 28 to a desired position (e.g., a fully open configuration with the sail fabric tightly drawn between the mast, boom, and paddle shaft) as depicted in FIG. 2C, and then lock the downhaul lock sleeve 68 in the desired position to hold the sail in the desired position. Note that the user may wrap the sail lower portion partially around the paddle shaft 16, such as by rotating the downhaul lock sleeve 68 (with the lower sail loop 66 secured thereto) by 360 degrees or more in order to further tighten the sail, and/or to reduce/eliminate airflow between the paddle shaft 16 and sail 28. The sail 28 has a leading edge 46 and trailing edge 48. In order to re-stow the sail assembly 26, the operator disconnects the lower sail loop from the paddle (e.g., by unlocking the downhaul lock sleeve 68 and sliding it upward to reduce sail tension and then disconnect the lower sail loop 66 therefrom). The operator then gathers the sail 28 upward and pushes the boom 34 upward until the boom is substantially parallel with the mast 32, as depicted in FIG. 2B. The operator can then push down on the sail assembly cap 60 to slide the sail assembly 26 back into the paddle shaft 16.

Figure 3:
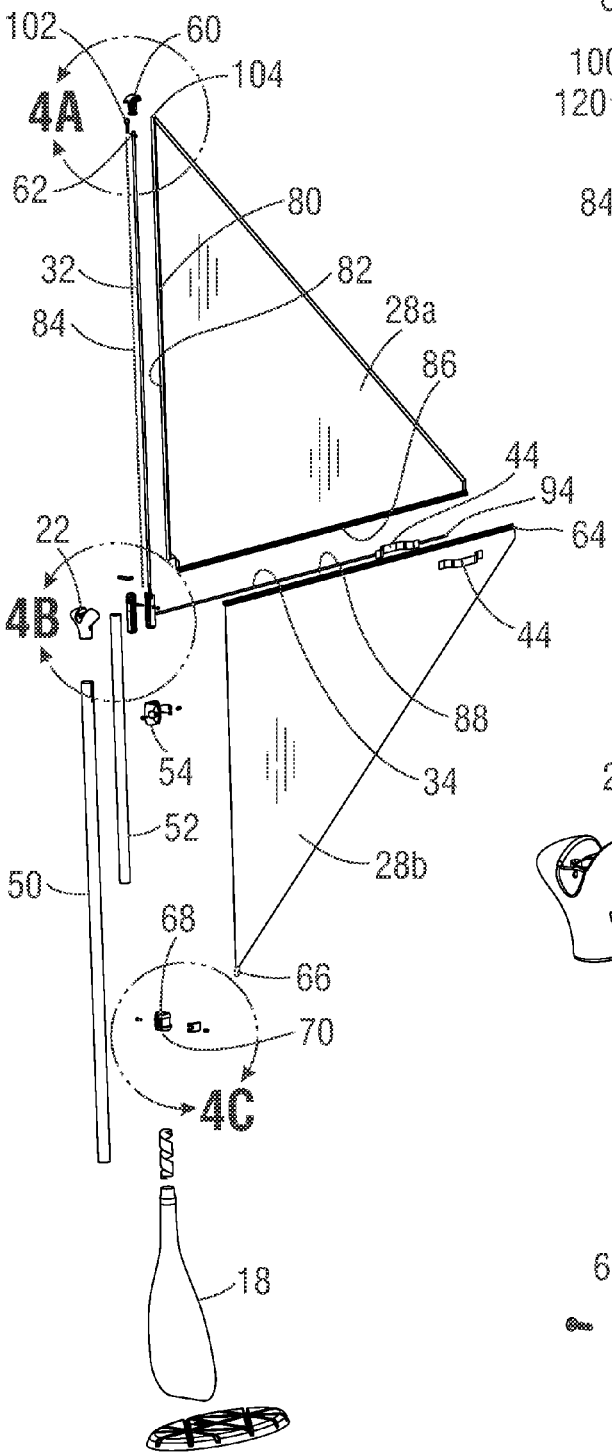
FIG. 3 depicts a perspective (exploded) view of the paddle of FIGS. 2A-2C.

The individual components of the sail of FIGS. 2A-2C are depicted in exploded view in FIGS. 3 and 4A-4C. As shown in FIG. 3, the sail 28 includes an upper portion 28*a* and a lower portion 28*b*. The sail upper portion 28*a* may have a front sleeve 80 along the leading edge 82 thereof configured to slidingly receive the mast 32, and possibly a leading edge cord 84, therein. The lower edge 86 of the sail upper portion 28*a* and the upper edge 88 of the sail lower portion 28*b* may be sewn together in overlapping fashion to form a central sleeve 90 (with the lower edge 86 forming one side and the upper edge 88 forming the other side thereof) configured to receive the boom 34 therein. The central sleeve 90 may be sealed at the distal end 92 thereof to prevent the boom distal end 64 from extending out of the central sleeve distal end 92. A cap 94 (possibly formed of a soft rubber-like material) may be provided on the boom distal end 64 to cushion the end thereof to prevent the boom distal end 64 from penetrating the sealed distal end 92 of the central sleeve 90.

Figure 4A:
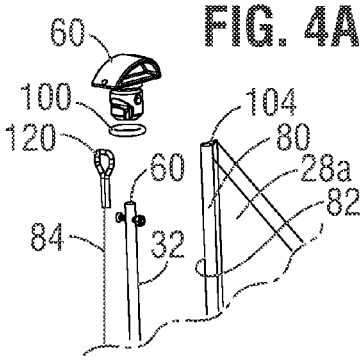
FIGS. 4A-4C depict close-up (exploded) perspective views of portions of the paddle of FIG. 3.

As depicted in FIG. 4A, the top cap 60 includes an O-ring 100 which, when the sail assembly 26 is in the fully stowed configuration with the top cap 60 fully seated into the paddle handle 22, seals around the top cap 60 to prevent water from flowing around the top cap 60 and into the paddle shaft 16. The sail upper portion 28*a* is secured to the top cap 60 via an upper sail loop 102. The upper sail loop 102 may be an upper end of a leading edge cord 84, and/or may be secured directly to the uppermost corner 104 of the upper sail portion 28*a*.

Figure 4B:
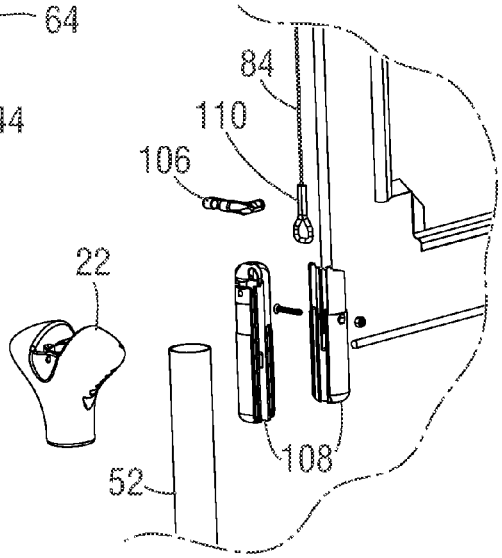
Figure 4C:
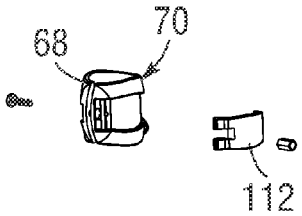
Figures 5A, 5B, 5C, 5D:
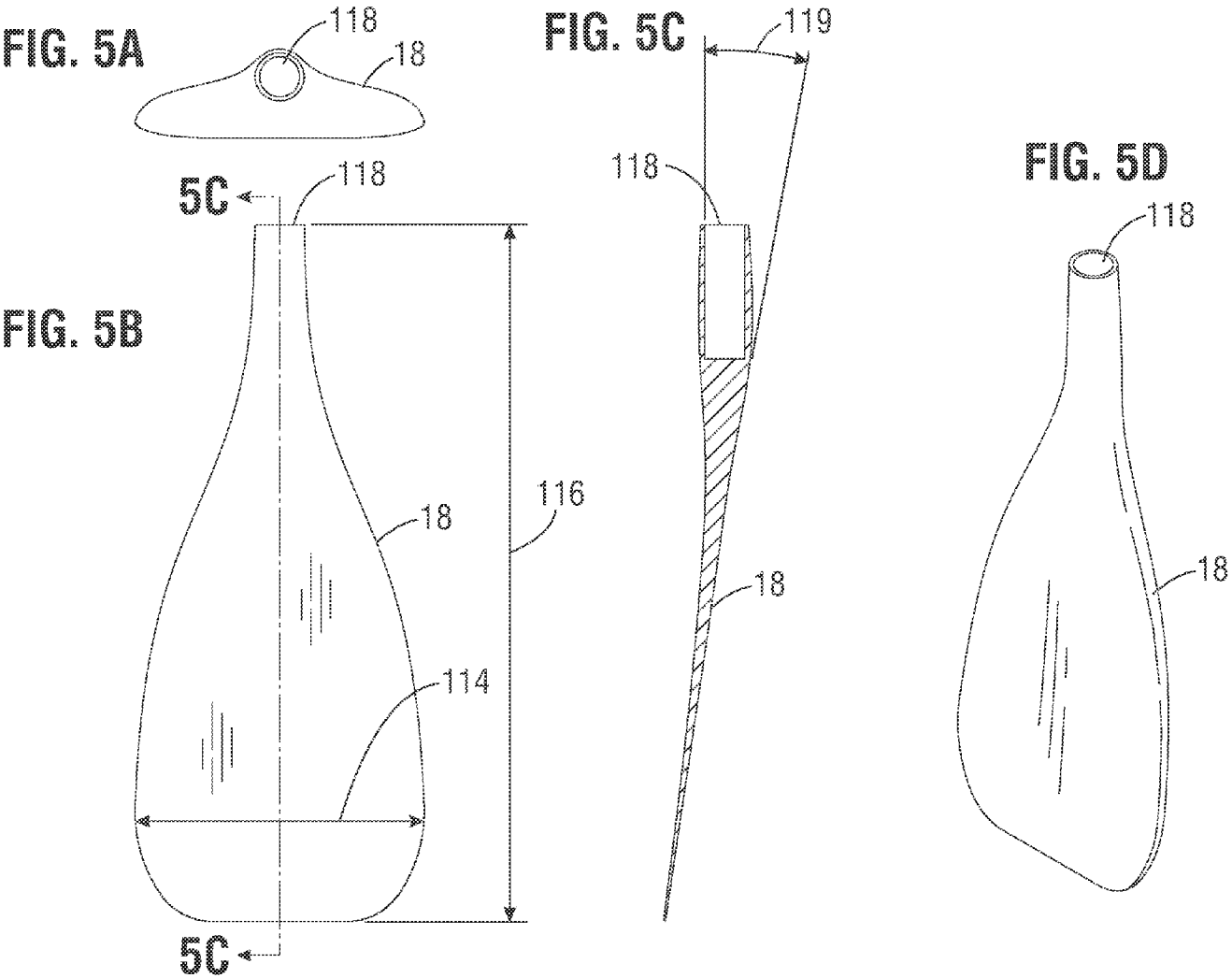
FIGS. 5A-5D depict top, front, side (cross-sectional), and perspective views of a paddle blade according to an embodiment of the invention.
Figures 6A, 6B, 6C, 6D, 6E, 6F:
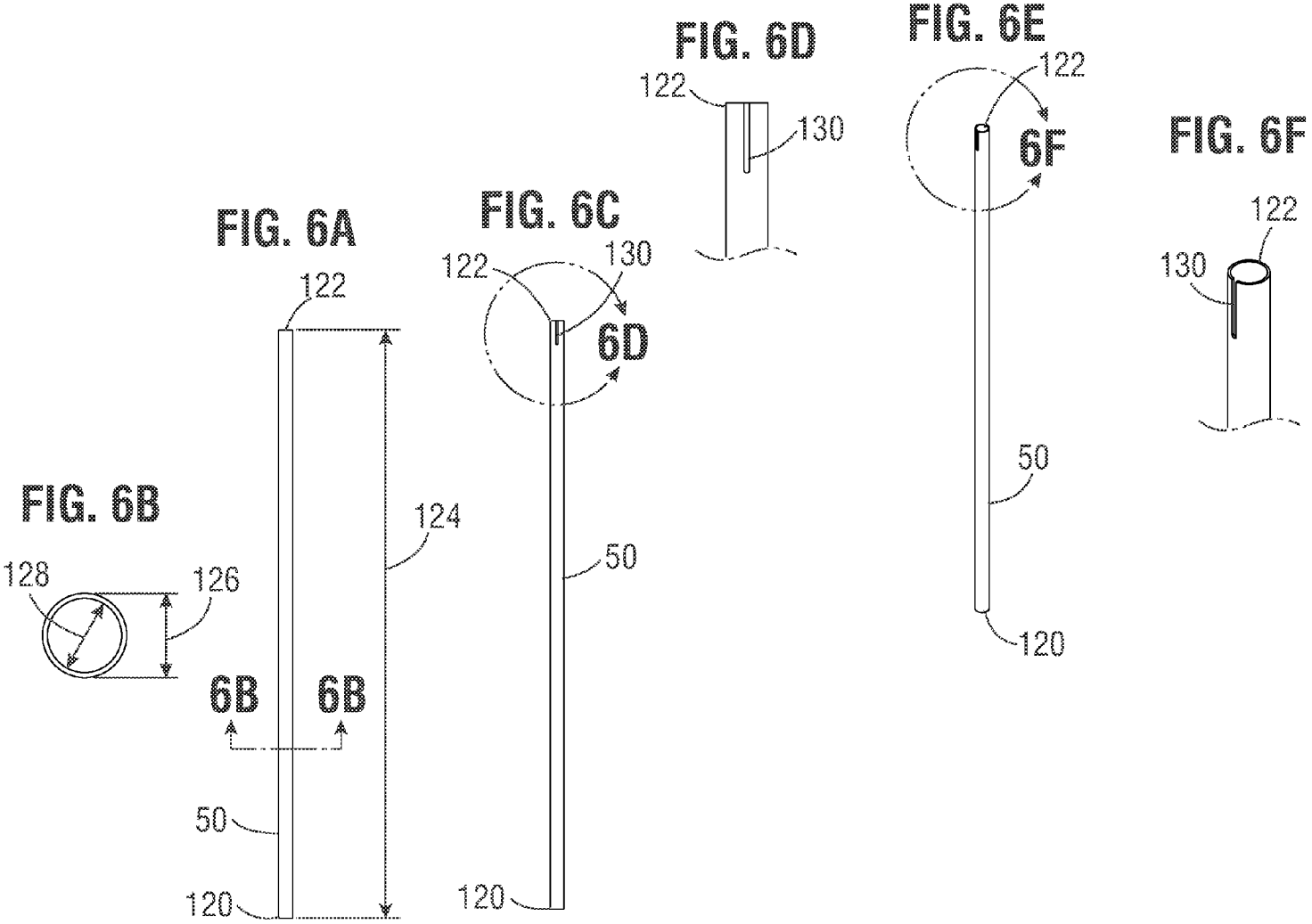
FIGS. 6A-6F depict side, top (cross-sectional), side, side (close-up), perspective, and perspective (close-up) views of a lower portion of a paddle shaft according to an embodiment of the invention.

FIG. 4B depicts the handle 22 and the lower portions of the sail assembly 26, including the mast 32, boom 34, yoke 106, and slider 108. A center sail loop 110, which may be a lower end of a leading edge cord 84, is secured to the slider 108, such as via a hook on the slider (not shown). The downhaul lock sleeve 68 is depicted in FIG. 4C, with a lever 112 configured, when in the locked position, to compress the downhaul lock sleeve 68 onto the paddle shaft 16 to prevent the downhaul lock sleeve 68 from sliding thereon. The lower sail loop 66 is configured to be releasably secured to the hook 70 on the downhaul lock sleeve 68.

A paddle blade 18 according to an embodiment of the invention is depicted in FIGS. 5A-5D, the drawings of which are to scale. The blade has a width 114, which may be between 7 and 10 inches, and a height 116 which may be between 12 and 24 inches. An upper connection 118 on the blade 18 is configured to be secured to the proximal end of the paddle shaft. In the particular embodiment depicted, the upper connection 118 comprises a cylindrical opening configured to slidingly receive the proximal end of the paddle shaft. As shown in the side view of FIG. 5C, the paddle blade 18 is configured to be positioned at an angle 119 with respect to a paddle shaft secured within the upper connection 118. In the particular embodiment depicted, the angle 119 is about 9 degrees, although other angles (including angles of between 5 and 15 degrees) are also within the scope of the invention.

In the embodiments depicted in FIGS. 1-5, the paddle blade is depicted as being at about 90 degrees with respect to the deployed sail boom and deployed sail (about the axis defined by the paddle shaft). However, for some sailing configurations, other blade-to-sail angles (i.e., angle of blade with respect to sail/sail boom) may be desired. The sail boom 34 and sail 28 can be rotated with respect to the paddle blade 18 by unlocking the locking mechanism 54, thus permitting the upper shaft portion 52 (to which the sail boom 34 is attached) to rotate within the lower shaft portion 50 (to which the paddle blade 18 is attached). Once the upper shaft portion 52 and lower shaft portions 50 (and thus the sail boom 34 and paddle blade 18) have been rotated with respect to each other to a desired orientation, the locking mechanism 54 can be re-locked at the desired position.

A lower shaft portion 50 of a paddle shaft 16 according to an embodiment of the invention is depicted in FIGS. 6A-6F. The lower shaft portion 50 has a proximal (lower) end 120 and a distal (upper) end 122 and an overall length 124. The length 124 may be between 30 and 66 inches, or between 36 and 60 inches, or between 44 and 52 inches (although other lengths are also within the scope of the invention), and in the particular embodiment depicted the length 124 is about 48 inches (1220 mm). The lower shaft portion 50 has an outer diameter 126, which may be from 1 to 2 inches (although other diameters are also within the scope of the invention), and which may be sized to fit tightly into an opening such as the blade upper end connection depicted in FIGS. 5A-5F. In the particular embodiment depicted, the outer diameter 126 is about 1.15 inch (29 mm). The lower shaft portion includes an inner diameter 128, which may be between ¾ and 1¾ inches and which may be sized to slidingly receive the upper shaft portion 52 therein in a relatively tight manner so that the upper shaft portion 52 can slide therein but wherein the two portions can be locked to prevent further sliding by applying a compressive force to the lower shaft portion 50. In the particular embodiment depicted, the inner diameter 128 is about 1 inch (25.7 mm) (although other diameters are also within the scope of the invention). A compression slot 130 may be positioned adjacent the distal (upper) end and permits the distal (upper) end to be compressed, such as via a compressive shaft locking mechanism, to narrow the inner diameter at the distal end in order to lock the upper shaft portion 52 within the lower shaft portion 50 to prevent relative movement therebetween and thereby fix the overall length of the paddle. In a preferred embodiment, the difference between the lower shaft portion inner diameter 128 and the upper shaft portion outer diameter 136 is between 1 and 3 mm. In the particular embodiment, the difference is 2 mm.

Figure 7C:
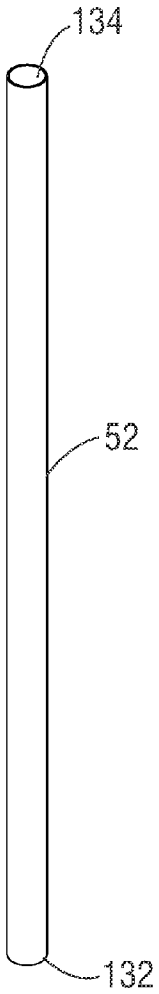
FIGS. 7A-7C depict side, top (cross-sectional), and perspective views of an upper portion of a paddle shaft according to an embodiment of the invention.
Figure 7B:
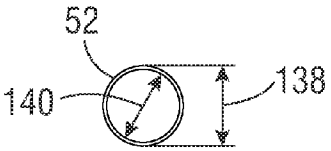
Figure 7A:
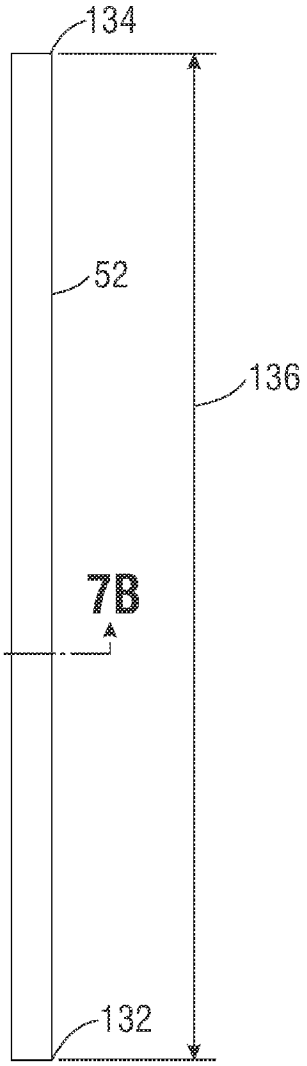
Figure 8A:
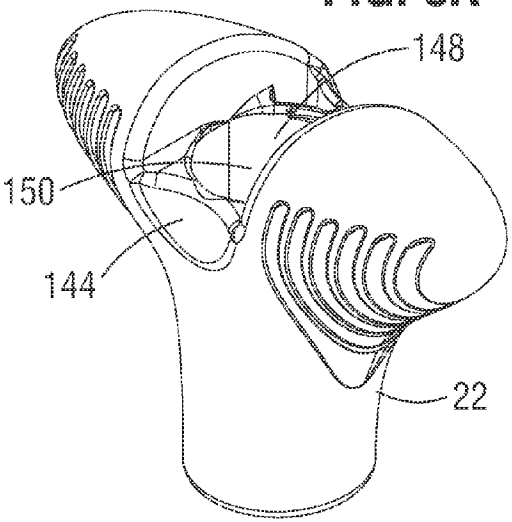
FIGS. 8A-8F depict perspective, top, back, front, side, and side (cross-sectional) views of a paddle handle according to an embodiment of the invention.
Figure 8B:
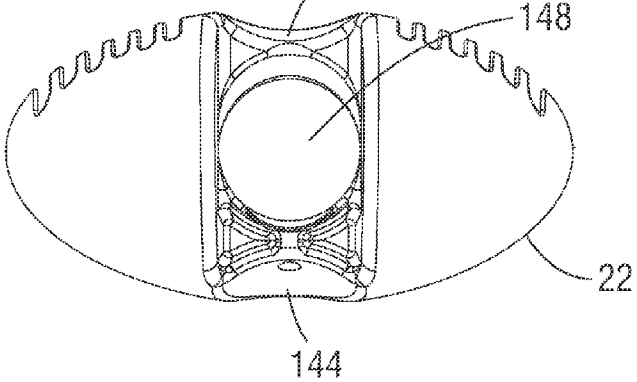
Figure 8C:
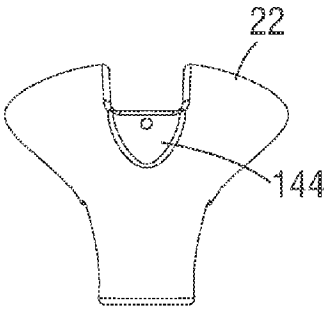
Figure 8D:
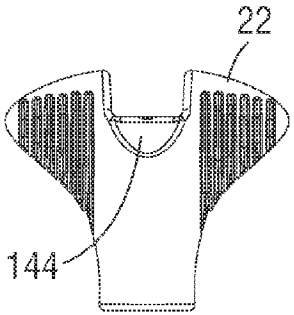
Figure 8E:
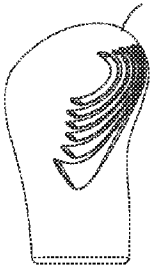
Figure 8F:
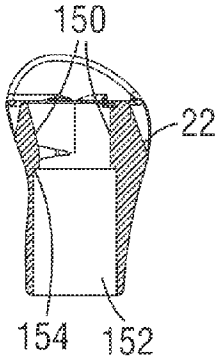
Figure 9B:
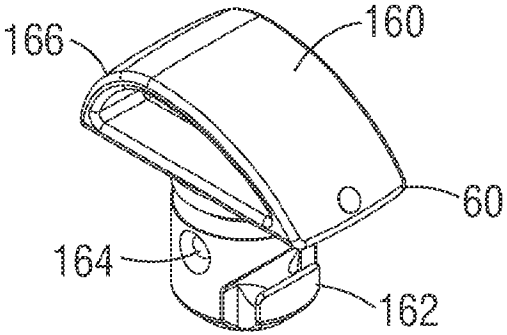
FIGS. 9A-9E depict front perspective, rear perspective, side, front, and bottom views of a sail top cap according to an embodiment of the invention.
Figure 9E:
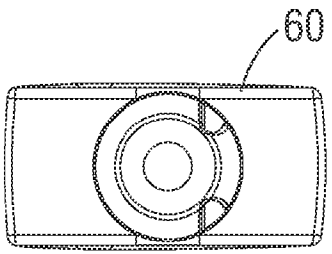
Figure 9D:
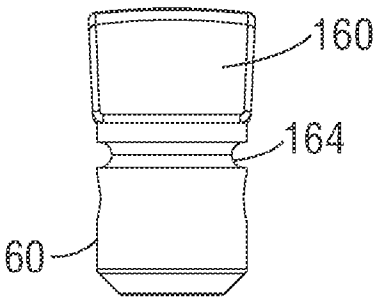
Figure 9A:
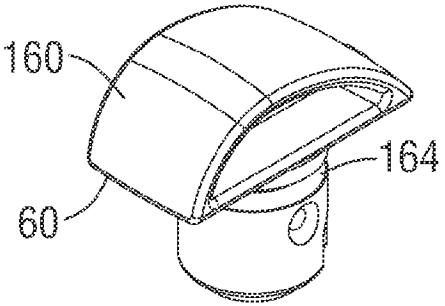
Figure 9C:
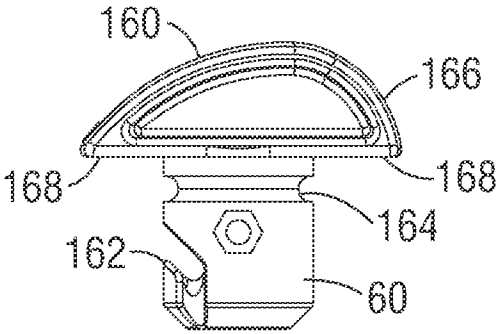

An upper shaft portion 52 of a paddle shaft 16 according to an embodiment of the invention is depicted in FIGS. 7A-7C. The upper shaft portion 52 has a proximal (lower) end 132 and a distal (upper) end 134 and an overall length 136. The length 136 may be between 16 and 40 inches, or between 24 and 32 inches (although other lengths are also within the scope of the invention), and in the particular embodiment depicted the length 136 is about 27 inches (686 mm). The upper shaft portion 52 has an outer diameter 138, which may be between ⅞ and 1½ inches (although other diameters are also within the scope of the invention), and which may be sized, at the upper shaft proximal (lower) end 132, to be slidingly received within an upper opening in the lower shaft portion 50, and also may be sized, at the upper shaft distal (upper) end 134, to be tightly fit into a lower opening in the paddle handle. In the particular embodiment depicted, the outer diameter 138 is about 1 inch (25.5 mm). The upper shaft portion 52 has an inner diameter 140 which may be sized to slidingly receive the sail assembly, including the slider, yoke, mast, boom, and sail. The inner diameter 140 may be between 0.5 and 1¼ inches (13 mm-32 mm), although other diameters are also within the scope of the invention. In the particular embodiment depicted, the inner diameter 140 is about 0.92 inch (23.3 mm).

A paddle handle 22 according to an embodiment of the invention is depicted in FIGS. 8A-8F. The particular handle 22 is substantially T-shaped, with small finger grooves 144 formed at the front and back toward the top 146 thereof for easier grasping of a sail cap positioned therein. A hole 148 passes through the handle 22, with the hole 148 configured to permit a sail assembly to slide therethrough. The hole 148 has a smooth and tapered upper portion 150, with the tapered shape configured to facilitate easier advancement of the sail assembly, including the sail, into the handle hole 148. The tapered upper portion 150 thus acts as a funnel to facilitate stowing of the sail assembly. The hole 148 has a lower portion 152, with a small step-like overhang 154 between the upper portion 150 and lower portion 152 where the inner diameter of the hole 148 is suddenly reduced between the upper portion 150 and the lower portion 152. The small step-like overhang 154 may act as a block to prevent the slider (where the slider diameter is larger than the hole diameter at the step-like overhang) of the sail assembly from being pulled out of the paddle through the hole.

A sail top cap 60 according to an embodiment of the invention is depicted in FIGS. 9A-9E. The sail top cap 60 may include an upper surface 160 that is contoured to match the contours of a handle (such as that depicted in FIGS. 8A-8E) when the top cap 60 is secured within a hole in the handle. The top cap 60 may include a notch 162 configured to receive and retain a sail loop (such as the upper sail loop) in a hook-like manner. A circular groove 164 encircles the sail top cap 60 just below the upper portion 166 thereof, with the circular groove 164 serving as a retention groove for an O-ring (not shown), such as the O-ring shown in FIG. 4A. The O-ring provides a water-tight seal between the top cap 60 and paddle handle when the top cap 60 is secured within a hole in a paddle handle such as that depicted in FIGS. 8A-8E. The top cap upper portion 166 includes overhangs 168 which, when the top cap 60 is secured within a handle such as that depicted in FIGS. 8A-8E, extend over the finger grooves in the handle and permit a user to easily grasp and pull the top cap out of the handle.

Figure 10B:
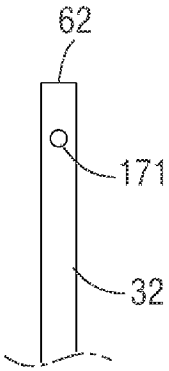
FIGS. 10A-10C depict side, side (close-up), and side (close-up) views of a mast according to an embodiment of the invention.
Figure 10C:
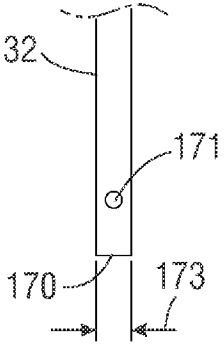
Figure 10A:
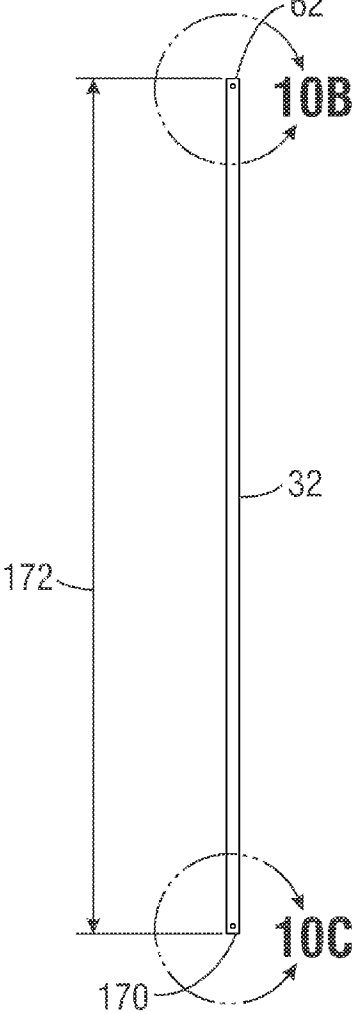
Figure 13D:
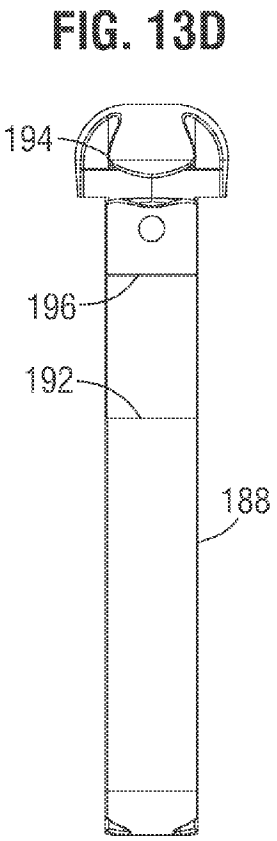
FIGS. 13A-13E depict perspective, top, side, front, and back views of an inner slider portion according to an embodiment of the invention.
Figure 13C:
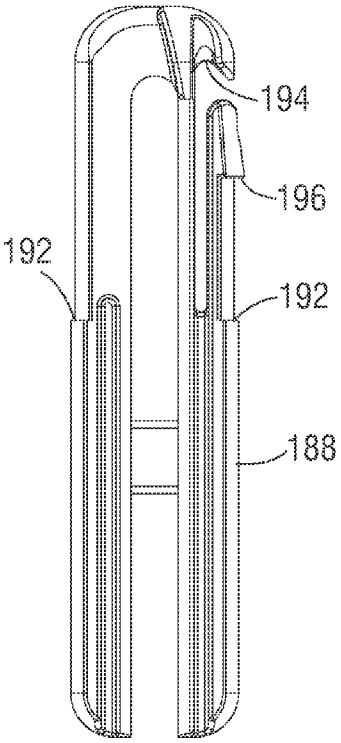
Figure 13B:
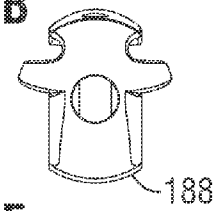
Figure 13E:
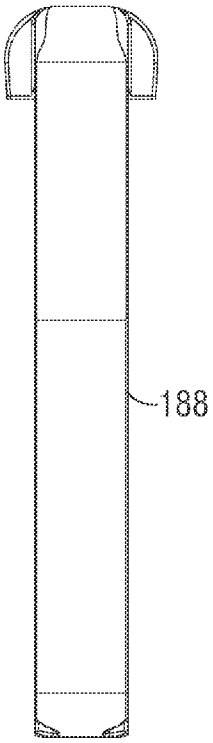
Figure 13A:
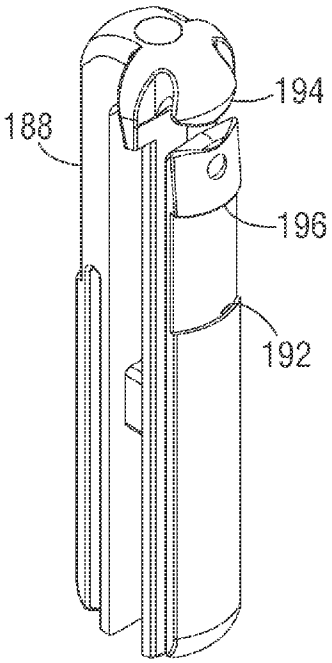
Figure 14A:
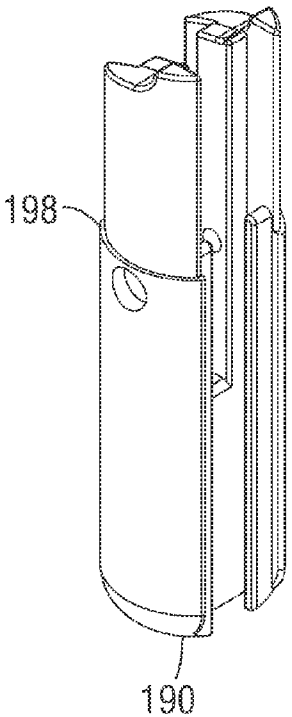
FIGS. 14A-14E depict perspective, top, side, front, and back views of an outer slider portion according to an embodiment of the invention.
Figure 14B:
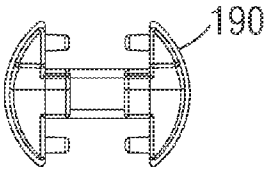
Figure 14C:
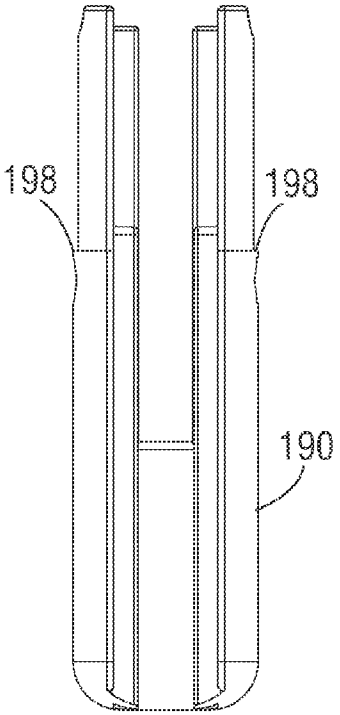
Figure 14D:
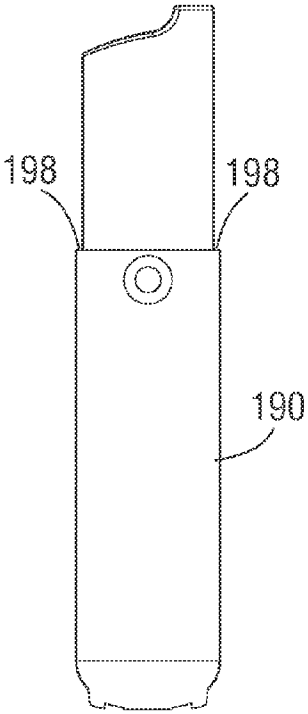
Figure 14E:
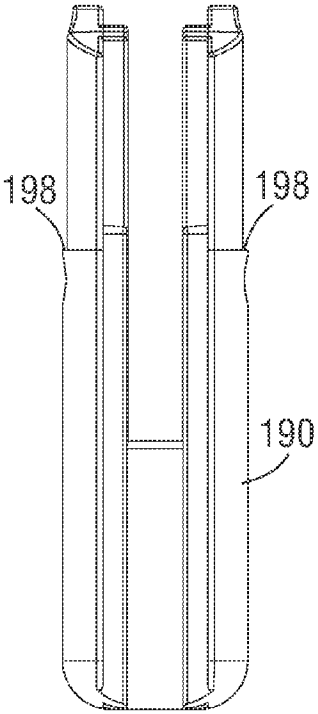

FIGS. 10A-10C depict a mast 32 according to an embodiment of the invention. The mast 32 has a proximal (lower) end 170 and a distal (upper) end 62 and a length 172 therebetween. Connection holes 171 may be provided, such as screw holes, to facilitate securing the mast 32 to a slider and/or top cap of the paddle. The mast may have a length 172 of between 30 and 60 inches, or between 40 and 50 inches, although other lengths are also within the scope of the invention. The mast may have a diameter of between 3/16 and ½ inches (4.75 mm to 13 mm), although other diameters are also within the scope of the invention. The mast 32 may be formed of various materials, such as fiberglass or carbon fiber or thermoplastic materials. The mast 32 may have sufficient flexibility to permit the mast 32 to deform slightly when subjected to the force from the tightening of the sail (e.g., when the downhaul it tightened) or from a sudden force, such as sudden gust of wind, but also to be able to return to its original shape once the force is removed. The mast 32 should also have sufficient resistance to tensile and compressive forces to withstand the force created when a user pulls the sail assembly out of the paddle shaft and when a user pushes the sail assembly back into the paddle shaft, during which times the pushing (compression) and pulling (tensile) forces will largely be carried by the mast 32. Due to the somewhat large forces thus applied to the mast (as compared to the boom), the use of screws or other connectors applied to the connection holes 171 may be desirable to secure the mast to the slider and/or to the top cap. In one embodiment, the mast 32 is formed from carbon fiber and the mast length 172 is about 48 inches (1220 mm), with a diameter 173 of about ¼ inch (6.4 mm). The mast 32 may preferably have a diameter greater than (by perhaps 50% to 100% or more) that of the boom, so that the boom will have greater flexibility as compared to the mast.

Figure 11:
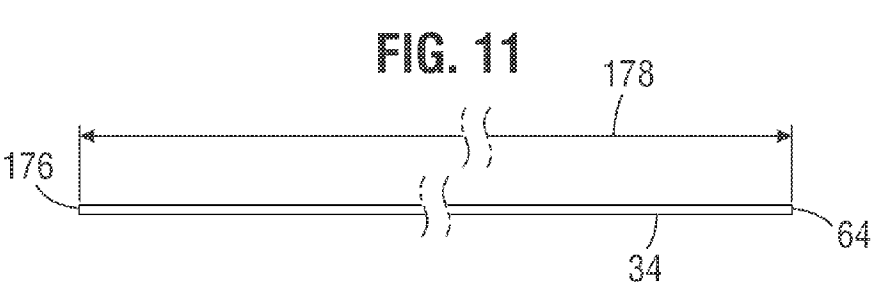
FIG. 11 depicts a side view of a boom according to an embodiment of the invention.

FIG. 11 depicts a boom 34 according to an embodiment of the invention. The boom has a proximal (lower) end and a distal (upper) end, with a boom length 178 therebetween. The boom length may be between 28 and 58 inches (710 mm to 1475 mm) with a diameter between 0.1 and 0.4 inches (2.5 mm to 10 mm), although other lengths and diameters are also within the scope of the invention. The boom 34 may be formed of various materials, such as fiberglass or carbon fiber or thermoplastics. The boom 34 may have sufficient flexibility to permit the boom to deform when subjected to a sudden force, such as sudden gust of wind, and to return to its original shape one the force is removed. The boom 34 may preferably be configured to flex easily so that the sail assembly can flex sideways when subjected to a strong wind gust and thus spill most of the wind gust to prevent the operator from being tipped over by the wind gust. In one embodiment, the boom 34 is formed from carbon fiber and has a length of about 42 inches (1070 mm) and a diameter of about 0.19 inches (4.8 mm). The boom may preferably have a diameter less than that of the mast, so that the boom will have greater flexibility to spill wind gusts as compared to the mast. Note that in the embodiment depicted in FIGS. 2A-2C, the boom 34 has an overall length which is slightly less than that of the mast to thus permit the boom to be closely placed against the mast but with the boom distal end position just below the top cap.

Figure 12:
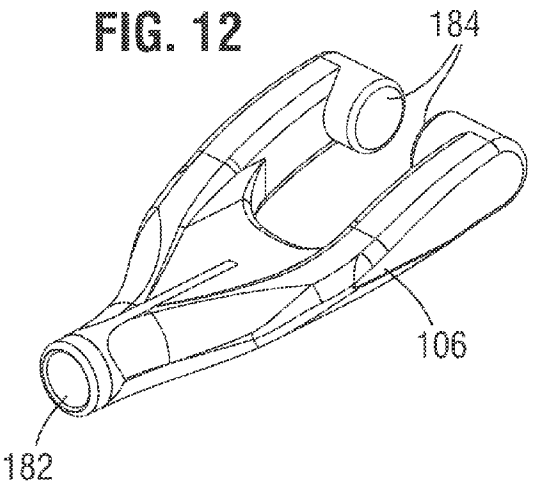
FIG. 12 depicts a perspective view of a boom yoke according to an embodiment of the invention.

A boom yoke 106 according to an embodiment of the invention is depicted in FIG. 12. The boom yoke 106 includes a boom-receiving opening 182 configured to receive and tightly secure the proximal end of the boom therein. The boom yoke 106 further includes hinge points 184 configured to connect to corresponding portions of a slider of the sail assembly. The boom yoke 106 may be formed from relatively rigid materials, including metals such as aluminum, stainless steel (possibly marine grade stainless steel), and/or titanium or from relatively rigid thermoplastics, to prevent the yoke from unwanted flexing.

A slider according to one embodiment of the invention is formed from an inner slider portion 188 depicted in FIGS. 13A-13E and an outer slider portion 190 depicted in FIGS. 14A-14E, with the inner slider portion 188 and outer slider portion 190 configured to mate together to form a complete slider portion. The inner slider portion 188 includes a lower step portion 192 on the front and back thereof, with the lower step portion 192 configured to interact with the step-like overhang 154 of the handle hole 148 to prevent the slider portion from being accidentally pulled out of the paddle shaft. The inner slider portion includes an upper notch 194 that forms a hook-like structure configured to receive and secure the central sail loop. The inner slider may further include a locking tab 196 that, when the sail assembly is deployed, locks the slider in a desired position within the handle (as more clearly depicted in FIG. 17 below). When it is desired to stow the sail assembly, the operator can release the locking tab by pressing inwardly against the tab. The locking tab may also unlock responsive to a sufficient downward forced being applied to the slider (e.g., via downward pressure on the top cab when an operator is stowing the sail assembly). The inner slider may be formed of various materials, such as thermoplastics, fiberglass, metal, etc. Materials may include ABS (acrylonitrile butadiene styrene) or PC/ABS (polycarbonate/acrylonitrile butadiene styrene) plastics or a glass-filled nylon. The materials may include so-called self-lubricating materials, such as polypropylene, to facilitate sliding of the slider within the paddle shaft inner lumen.

As depicted in FIGS. 14A-14E, the outer slider portion 190 also includes lower step portions 198 configured to interact with the step-like overhang 154 of the handle hole 148 to prevent the slider portion from being accidentally pulled out of the paddle shaft. The outer slider portion 190 may be formed of various materials, such as the materials discussed above with respect to the inner slider portion. The materials may include so-called self-lubricating materials.

Figure 15:
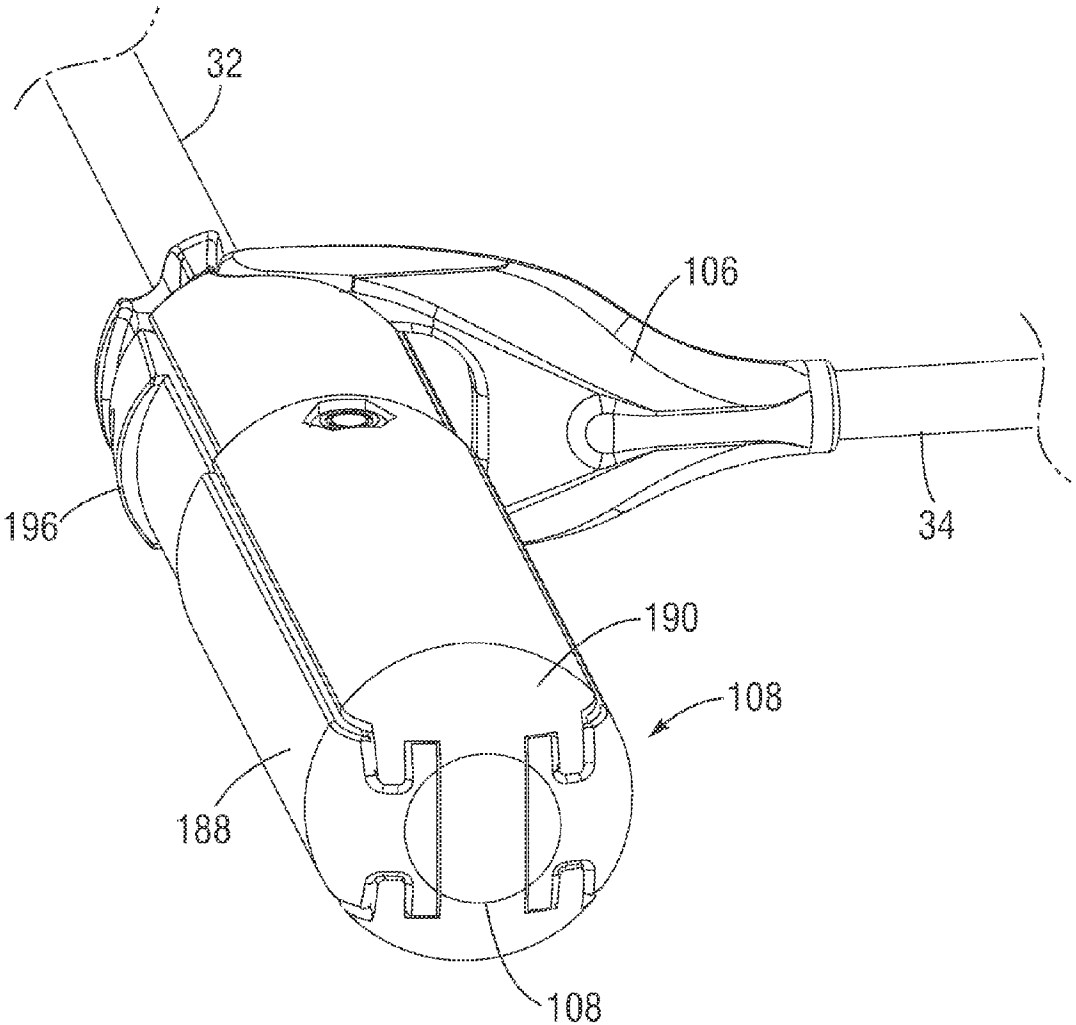
FIG. 15 depicts a perspective view of the inner and outer slider portions assembled with mast, yoke, and boom according to an embodiment of the invention.

FIG. 15 depicts a perspective view of the inner and outer slider portions 188, 190 assembled to form the complete slider 108, with mast 32, yoke 106, and boom 34 according to an embodiment of the invention. Note the locking tab 196.

Figure 16C:
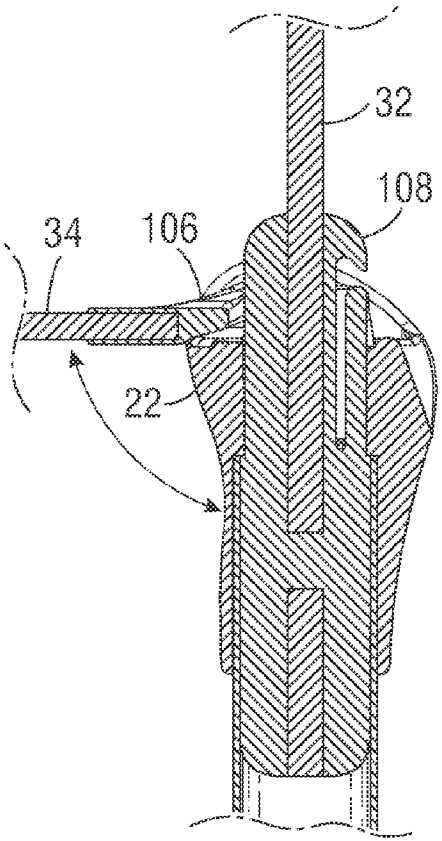
FIGS. 16A-16C depict side, side (cross-sectional), and side (cross-sectional) views of a distal portion of a paddle according to the invention, including the handle, slider, yoke, mast, and boom in the deployed configuration.
Figure 16B:
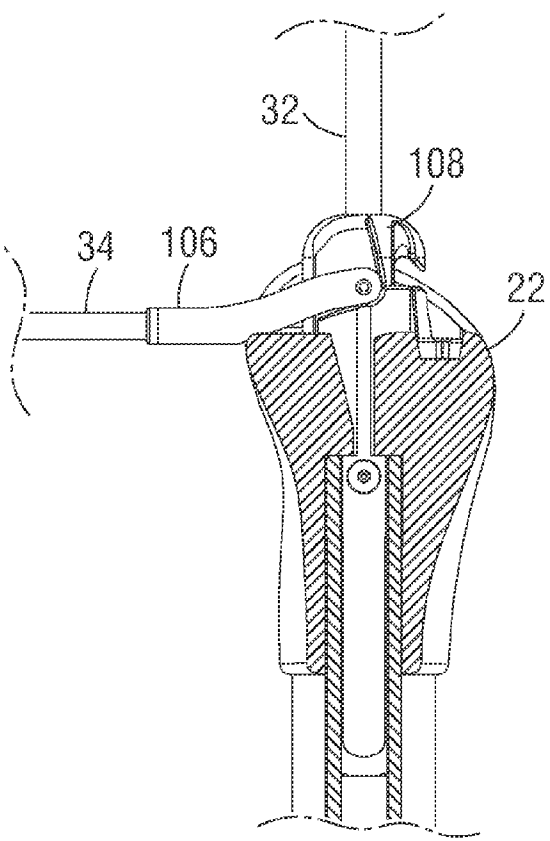
Figure 16A:
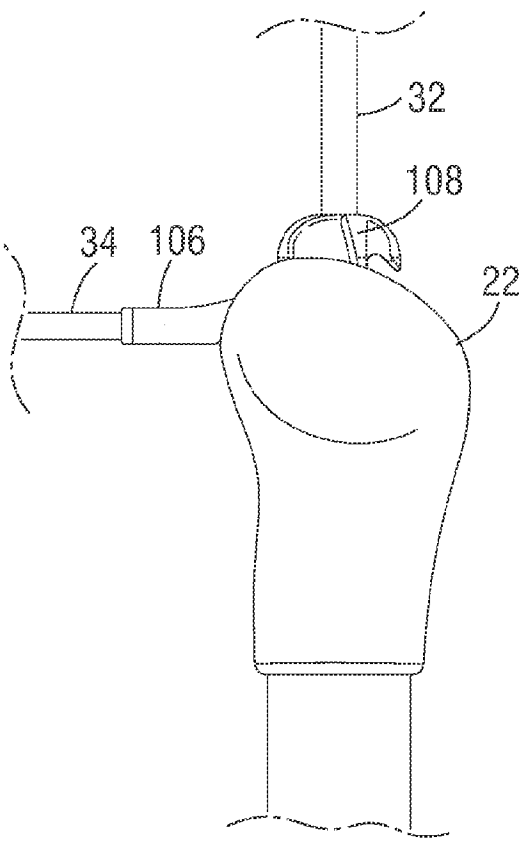

FIGS. 16A-16C depict side, side (cross-sectional), and side (cross-sectional) views of a distal portion of a paddle according to the invention, including the handle 22, slider 108, yoke 106, mast 32, and boom 34 in the deployed configuration. Note that in the particular embodiment depicted, the boom is at an angle 200 of 90 degrees from the mast and paddle shaft, although other boom angles 200 are also within the scope of the invention (e.g., between 60 and 120 degrees, between 75 and 105 degrees, between 80 and 100 degrees, etc.).

Figure 17:
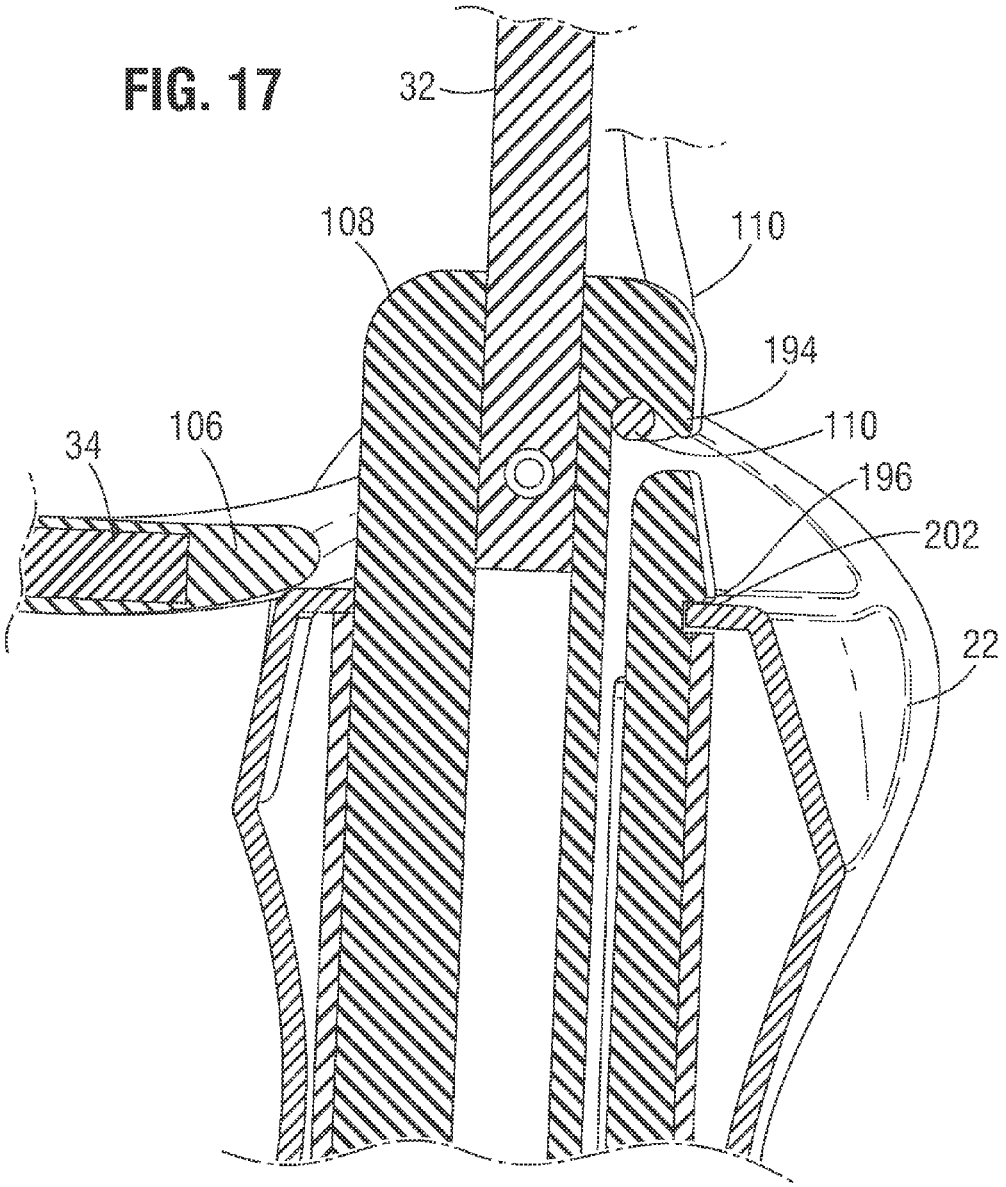
FIG. 17 depicts a perspective view, in cross-section, of a slider with the paddle in the deployed configuration according to an embodiment of the invention.
Figure 18A:
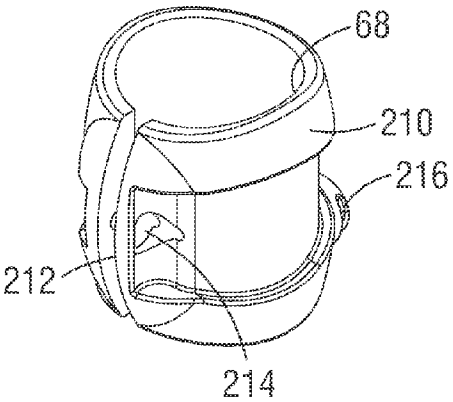
FIGS. 18A-18E depict perspective, top, front, side, and side views, respectively, of a downhaul lock according to an embodiment of the invention.
Figure 18B:
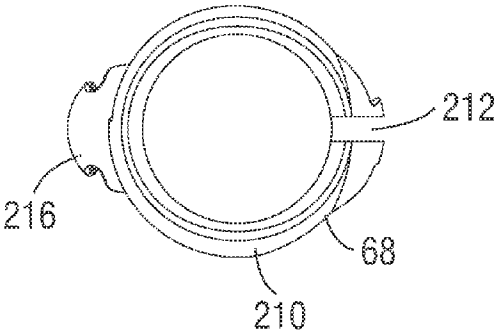
Figure 18C:
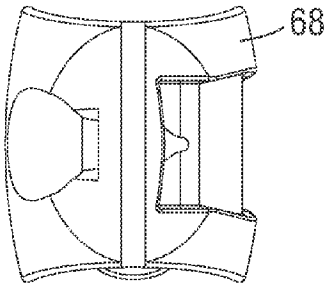
Figure 18D:
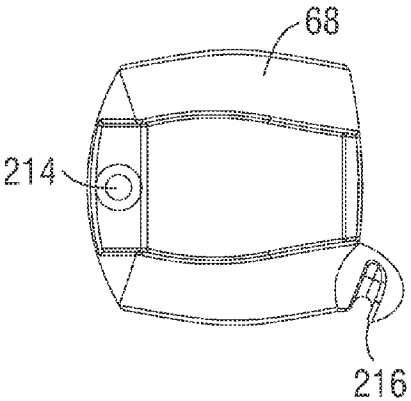
Figure 18E:
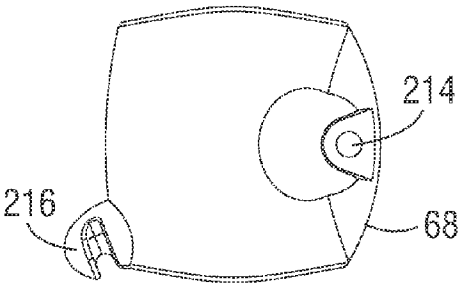

FIG. 17 depicts a slider 108 with the paddle in the deployed configuration according to an embodiment of the invention. Secured to the slider 108 are the mast 32 as well as the yoke 106 (which is rotatably secured to the slider 108 and also has the boom 34 secured therein). The slider 108 also includes the notch 194 which receives the sail middle loop 110 therein to thereby secure the sail to the slider 108. Note the locking tab 196, which is engaging against an upper surface 202 of the handle 22 adjacent the handle hole 148 to prevent the slider 108 from unwanted downward movement into the handle hole 148. An inward press (such as from an operator's finger) will cause the locking tab to move inward, thereby releasing the locking tab from engagement with the handle upper surface 202 and permitting the slider to be slid downward into the paddle shaft.

FIGS. 18A-18E depict a downhaul lock 68 according to an embodiment of the invention, with the downhaul lock 68 comprising a substantially annular structure 210 having an opening 212 at one side. The downhaul lock 68 is configured to be slidingly advanced along the paddle shaft to a desired location, and then compressed onto the paddle shaft to a locked position via a screw-like mechanism passing through holes 214 on either side of the opening 212. The downhaul lock 68 includes a hook-like appendage 216 configured to receive and secure the lower sail loop.

Figure 19C:
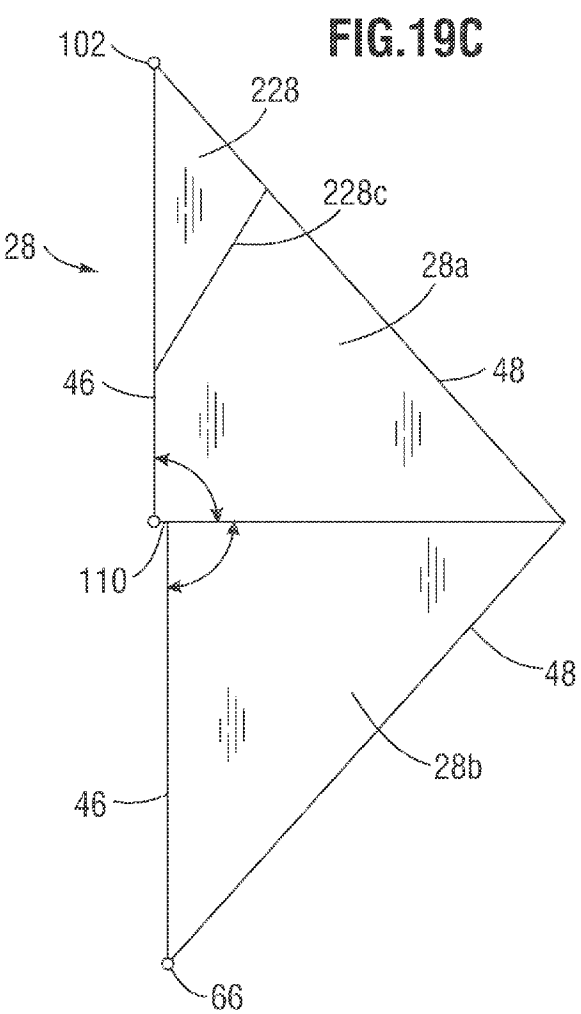
FIG. 19C depicts a side view of the top and side portions of FIGS. 19A and 19B assembled into a complete sail according to an embodiment of the invention.
Figure 19A:
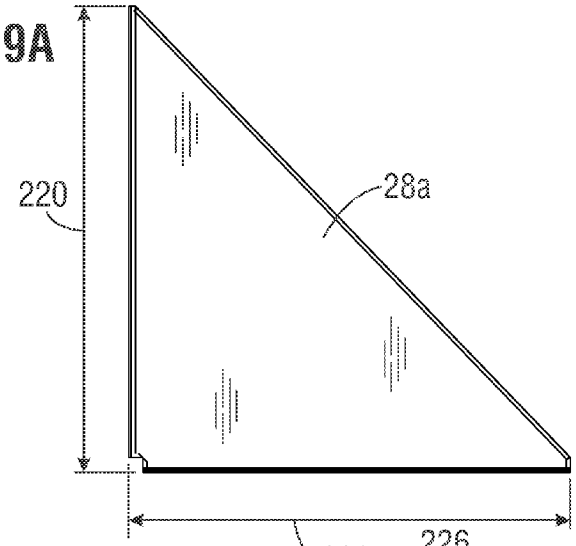
FIGS. 19A and 19B depict side views of the top portion and the lower portion, respectively, of a sail according to an embodiment of the invention.
Figure 19B:
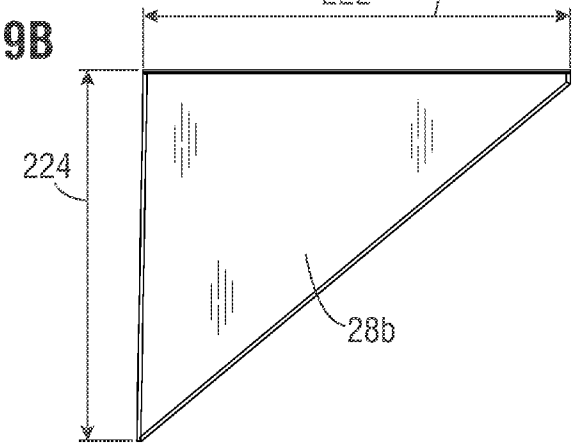

FIGS. 19A and 19B depict a top sail portion 28*a* and a lower sail portion 28*b*, respectively, of a sail according to an embodiment of the invention. The top sail portion 28*a* and/or lower sail portion 28*b* may be substantially triangular in shape as depicted. The top sail portion 28*a* may have a height 220 between 40 and 55 inches and a length 222 between 40 and 55 inches. The lower sail portion 28*b* may have a height 224 between 35 and 45 inches and a length 226 between 40 and 55 inches. Note that other heights and lengths are also within the scope of the invention. In one embodiment of the invention, the top sail portion has a height of 44 inches and a length of 43 inches, while the lower sail portion has a height of 39 inches and a length of 43 inches. Note that the upper and lower sail portions may be formed from a single piece of material, so that there is not separation in the material forming the upper and lower sail portions so that the sail is formed from a single continuous piece of material. The sail portions may include hemmed edges, which may include sleeves therein to receive a mast, boom, or other sail support structures therein. Materials used to form the sail include nylon, rayon, acetate, polyester, and polypropylene, including materials referred in the art as ripstop materials. The sail material may be 1.0 oz. to 2 oz. material, with a preferred range being 1.1 oz. to 1.3 oz. ripstop nylon material.

FIG. 19C depicts a complete sail 28 comprising a top sail portion 28*a* and a lower sail bottom 28*b*. The sail 28 includes so-called air pockets 228 at the upper corner thereof, with the air pockets 228 positioned on one or more sides of the sail 28. In the particular embodiment depicted, the air pockets 228 are positioned on both sides of the sail 28. The air pockets 228 are formed from pieces of material (which may be substantially triangular in shape, may be the same material of which the sail is formed, and/or may be substantially resistant to water and/or air passage therethrough) are from 12 to 32 inches (or 18 to 24 inches) in vertical length along the sail leading edge, and from 8 to 16 inches (or 11 to 15 inches) in trailing length along the sail trailing edge (although other dimensions are also within the scope of the invention). The air pockets 228 are secured to the sail at the leading edge thereof and also at the upper trailing edge thereof, but are open at the lower edge 228*c* of the air pocket material to thereby form an open pocket that captures a small amount of air when the sail 28 is stowed within the paddle shaft. The air captured within the air pockets 228 can prevent the paddle from sinking if the paddle is dropped in the water.

The sail 28 may be formed from a single, continuous piece of material. In the embodiment depicted, the upper portion extends slightly forward (e.g., by about ½ to 1½ inch, or by about 1 inch) of the lower portion at the sail leading edge at a position adjacent the sail middle loop, thus providing room for the sail middle loop.

A sail for use with a SUP paddle according to an embodiment of the invention thus comprises an upper sail portion 28*a* comprising a substantially right triangular shape with an upper sail horizontal leg, an upper sail vertical leg, and an upper sail hypotenuse, wherein the upper sail horizontal leg is between 40 and 45 inches in length, the upper sail vertical leg is between 41 and 45 inches in length, and the upper sail hypotenuse is between 56 and 62 inches in length. The sail 28 also comprises a lower sail portion 28*b* comprising a substantially right triangular shape with a lower sail horizontal leg, a lower sail vertical leg, and an lower sail hypotenuse, wherein the lower sail horizontal leg is between 39 and 44 inches in length, the lower sail vertical leg is between 36 and 41 inches in length, and the lower sail hypotenuse is between 53 and 59 inches in length.

The particular sail 28 depicted is thus formed from combination of the upper sail portion 28*a* and the lower sail portion 28*b*, and the upper sail portion and the lower sail portion are positioned with the upper sail horizontal leg and the lower sail horizontal leg adjacent to and parallel to each other and in contact in edge-to-edge fashion with each other, and the upper sail horizontal leg and the lower sail horizontal leg are positioned on a forward side of the sail in substantially parallel relationship to each other. The completed sail 28 thus has a leading edge 46 and a trailing edge 48, with upper, center, and lower sail loops to secure the sail to the sail support structure and/or paddle shaft or other portions of the paddle.

A paddle blade holder 42 is depicted in FIGS. 20A-20D. The paddle blade holder 42 is configured to be secured to the upper surface of a paddle board, such as depicted in FIG. 1. The paddle blade holder 42 includes a first set 230 of grooves and a second set 232 of grooves, with a dividing groove 234 therebetween. Each set of grooves comprises multiple grooves 236 centering on a central point 238, with the grooves spaced apart at different angles. In the particular embodiment depicted, the grooves 236 are spaced around the central point 238 at angles of about 45 degrees between adjacent grooves 236. Each groove is preferably sized to receive a paddle blade therein in order to prevent the paddle blade, and hence the paddle and deployed sail assembly, from being accidentally rotated to a non-desirable angle with respect to the SUP board. The holder 42 thus assists the operator in holding the paddle and sail assembly at a desired angle to the wind. The grooves may have a width of ¼ to 1 inch, and a depth of ¼ to 1 inch or more. The holder 42 may have a pressure-sensitive adhesive, which may be releasable responsive to upward (negative) pressure, on the lower surface thereof. The pressure sensitive adhesive may be covered by a peel-away covering that the operator can remove to expose the pressure sensitive adhesive and then press the holder on the desired surface of the SUP board. The holder 42 may have a length 240 between 6 and 16 inches (or between 8 and 12 inches), a width 242 between 5 and 8 inches, and a thickness 244 between ¼ and ¾ inches (although other lengths, widths, and thicknesses are also within the scope of the invention). The holder 42 may be formed from an easily compressible material such as a sealed foam rubber. Other materials include soft sponge/gel materials.

Figure 20B:
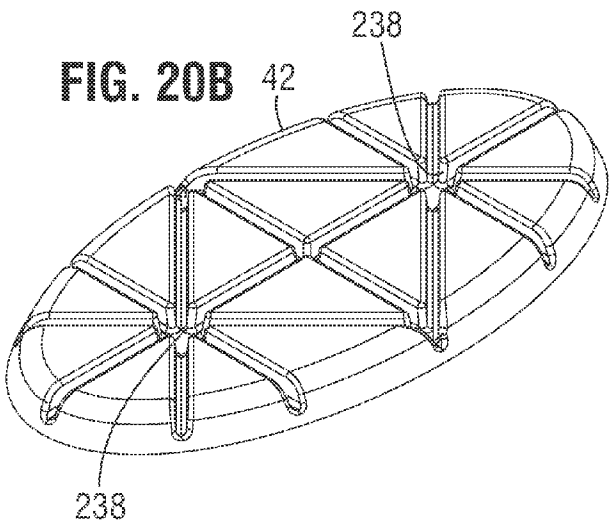
FIGS. 20A-20D depict top, perspective, front (cross-section), and front views of a paddle blade holder according to an embodiment of the invention.
Figure 20A:
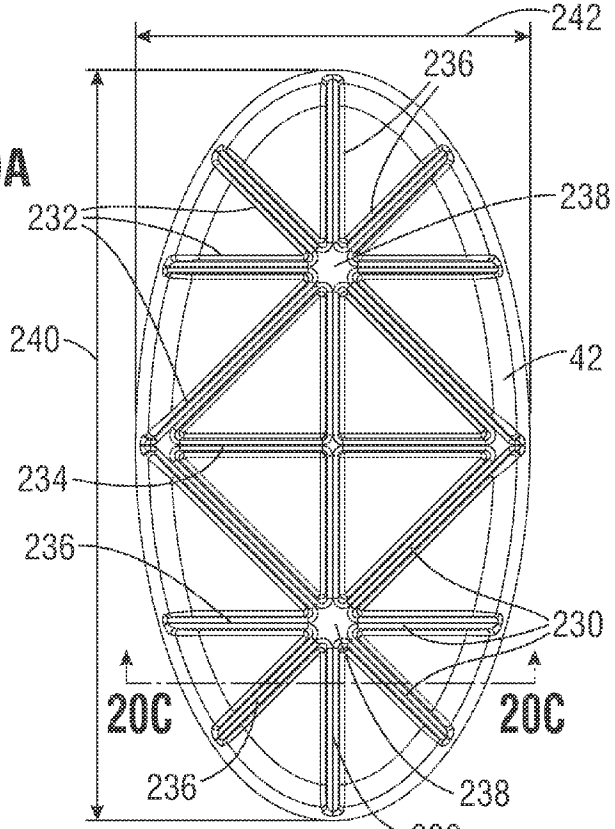
Figure 20C:
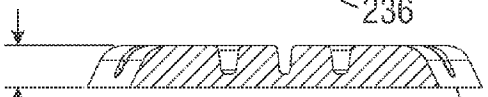
Figure 20D:
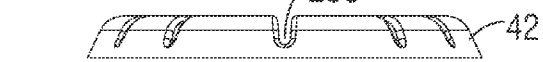
Figure 20E:
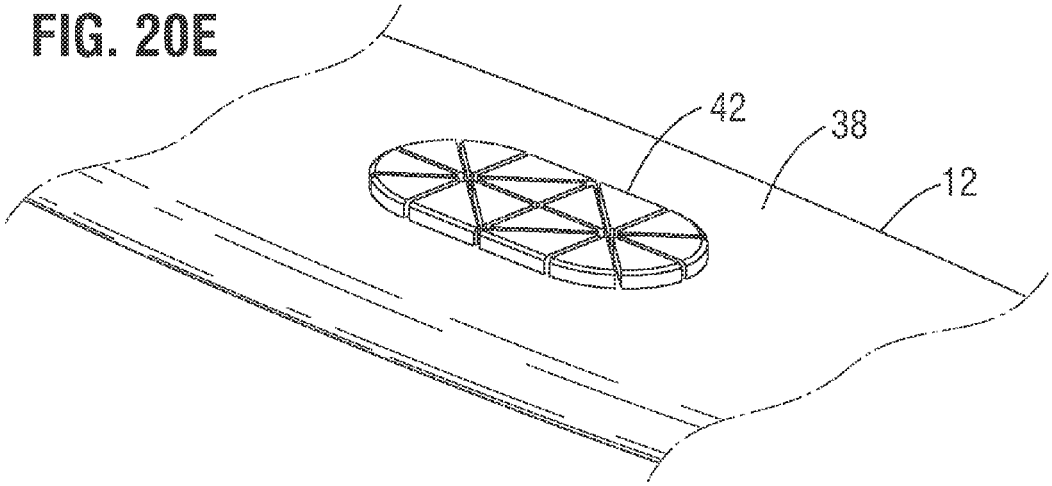
FIGS. 20E-F depict perspective views of the paddle blade holder of FIGS. 20A-20D secured to a paddle board and in use with a paddle according to an embodiment of the invention.
Figure 20F:
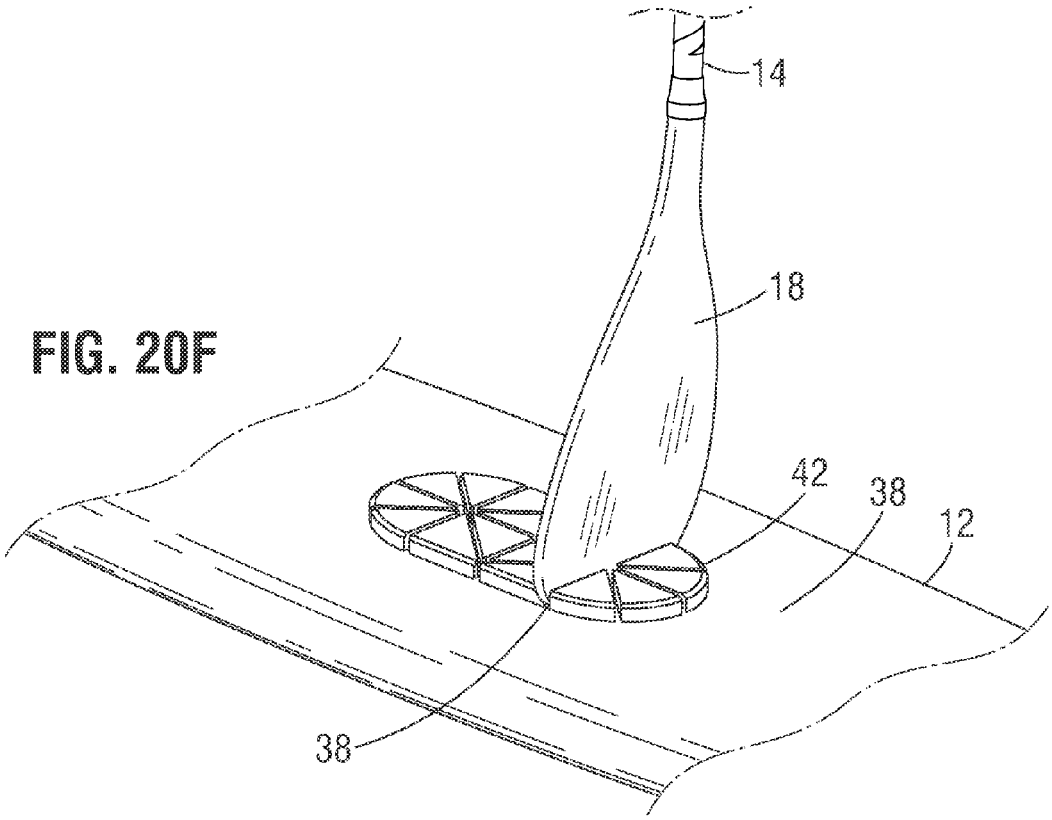

FIGS. 20E-F depict a paddle blade holder 42 such as that depicted in FIGS. 20A-20D secured to an SUP paddle board 12 and in use with a paddle 14 according to an embodiment of the invention. As depicted in FIG. 20F, the paddle blade 18 can be positioned within a desired groove of the holder 42 in order to assist the operator in holding the paddle at a steady angle when under sail.

Figure 21C:
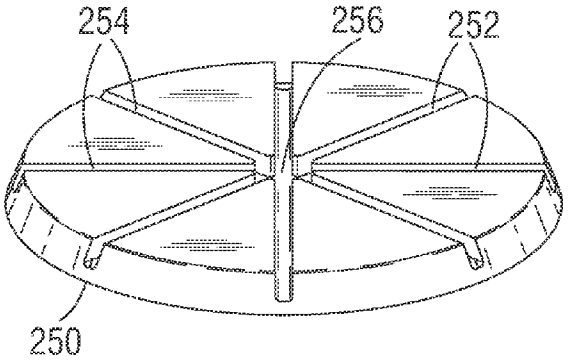
FIGS. 21A-21C depict top, perspective, and side views of a paddle blade holder according to an embodiment of the invention.
Figure 21A:
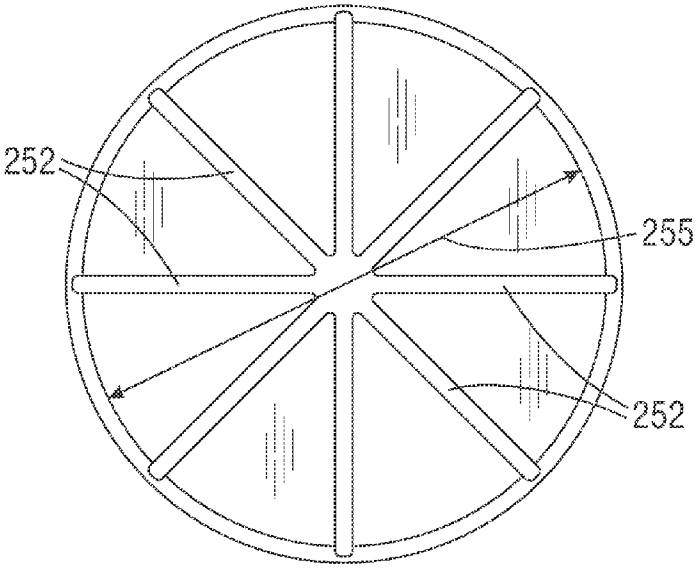
Figure 21B:
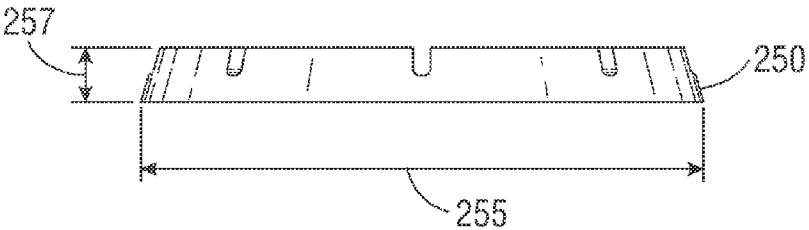

In one example of usage a paddle according to the invention, which may be particularly useful for downwind (e.g., board reach and/or running) travel on the board, the paddle blade 18 could be oriented lengthwise with respect to the paddle board (i.e., 90 degrees from the sideways orientation depicted in FIG. 20F) with the boom and sail extending to one side or the other. The user can grasp the paddle shaft with one hand, grasp the boom and/or boom handle (element 44 in FIG. 1) with the other, and keeping the body of sail substantially centered over the board in order to capture the wind. The sail could be angled forward or backward (e.g., by letting the boom/boom handle go forward or backward with respect to the paddle shaft) to improve the desired performance and adjust for wind direction. To steer the board to the right, the user could pivot the paddle shaft (and thus the entire sail) to the left of the board center position to thus position more sail area on the left side of the board, thus causing the board to turn to the right responsive to the added forward force on the left side of the board. Similarly, to steer the board to the left, the user could pivot the paddle shaft (and thus the entire sail) to the right of the board center position to thus position more sail area on the right side of the board, thus causing the board to turn to the left responsive to the added forward force on the right side of the board FIGS. 21A-21C depict a paddle blade holder 250 similar to that of FIGS. 20A-20F, but having a substantially circular shape according to an embodiment of the invention. The paddle blade holder 250 comprises a single set 252 of grooves 254, radiating from a single central point 256. The paddle blade holder 250 may have a diameter 255 between 5 and 14 inches (or between 8 and 10 inches), and a thickness 257 between ¼ and ¾ inches (although other diameters and thicknesses are also within the scope of the invention). The grooves may have a width of ¼ to 1 inch, and a depth of ¼ to 1 inch or more.

Figure 22A:
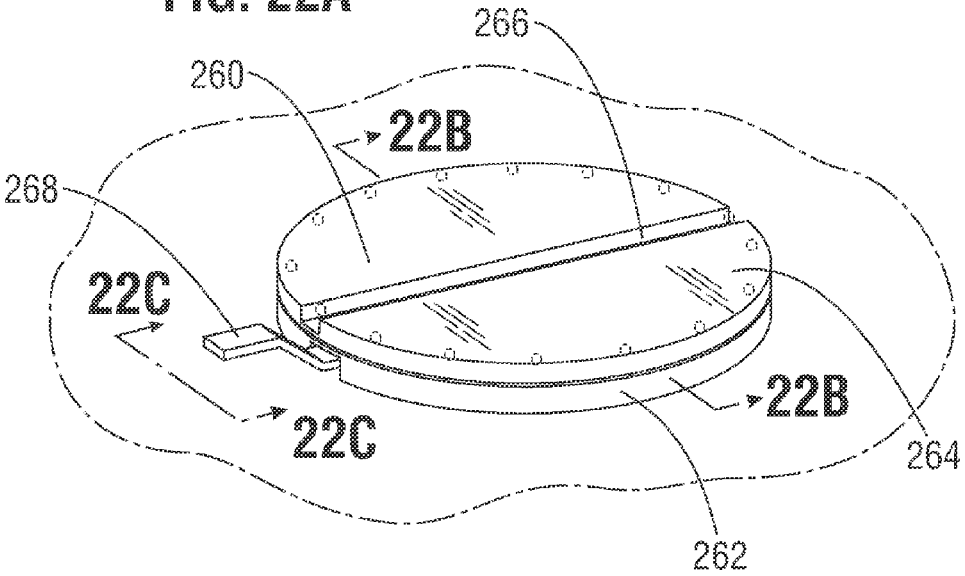
FIGS. 22A-22C depict perspective, front, and side (cross-sectional) views of a paddle blade holder according to an embodiment of the invention.
Figure 22B:
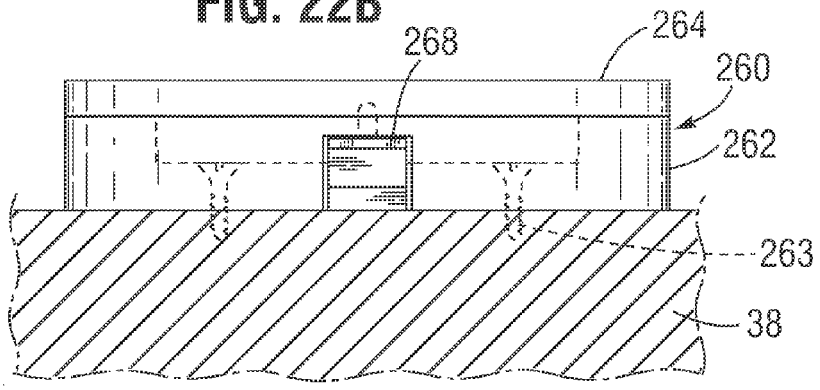
Figure 22C:
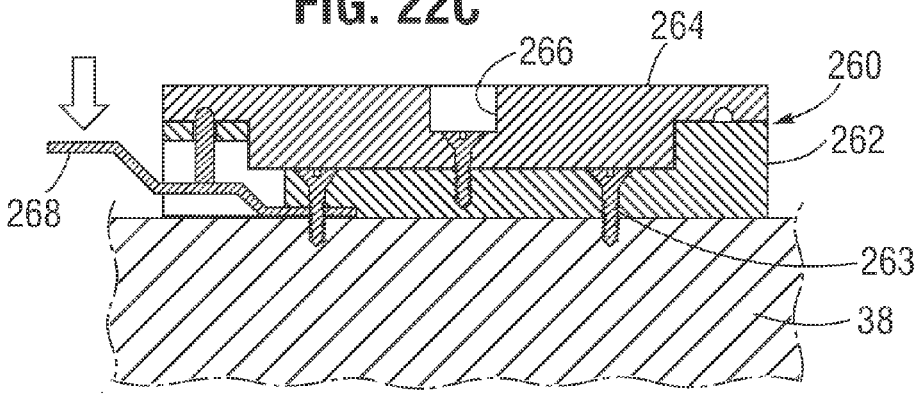

Another embodiment of a paddle blade holder 260 is depicted in FIGS. 22A-22C, and includes a fixed lower portion 262 (secured to an SUP paddle board 38 via such means as pressure-sensitive adhesive and/or screws 263) and an upper portion 264 that can rotate with respect to the lower portion 262. The paddle blade holder 260 may be substantially circular, with a diameter of between 5 to 12 inches. The upper portion 264 includes a paddle blade slot 266 configured to receive the paddle blade. The paddle blade slot may have a length of 8 to 12 inches and a width of 0.25 to 2 inches, with a depth of ⅛ to ¾ inches (although lengths, widths, and depths are also within the scope of the invention). A locking mechanism 268, such as a foot pedal, can be activated (via unlocking and locking) to permit the upper portion 264 to be selectively rotated to a desired angle and then locked into that position.

Figures 23A, 23B, 23C:
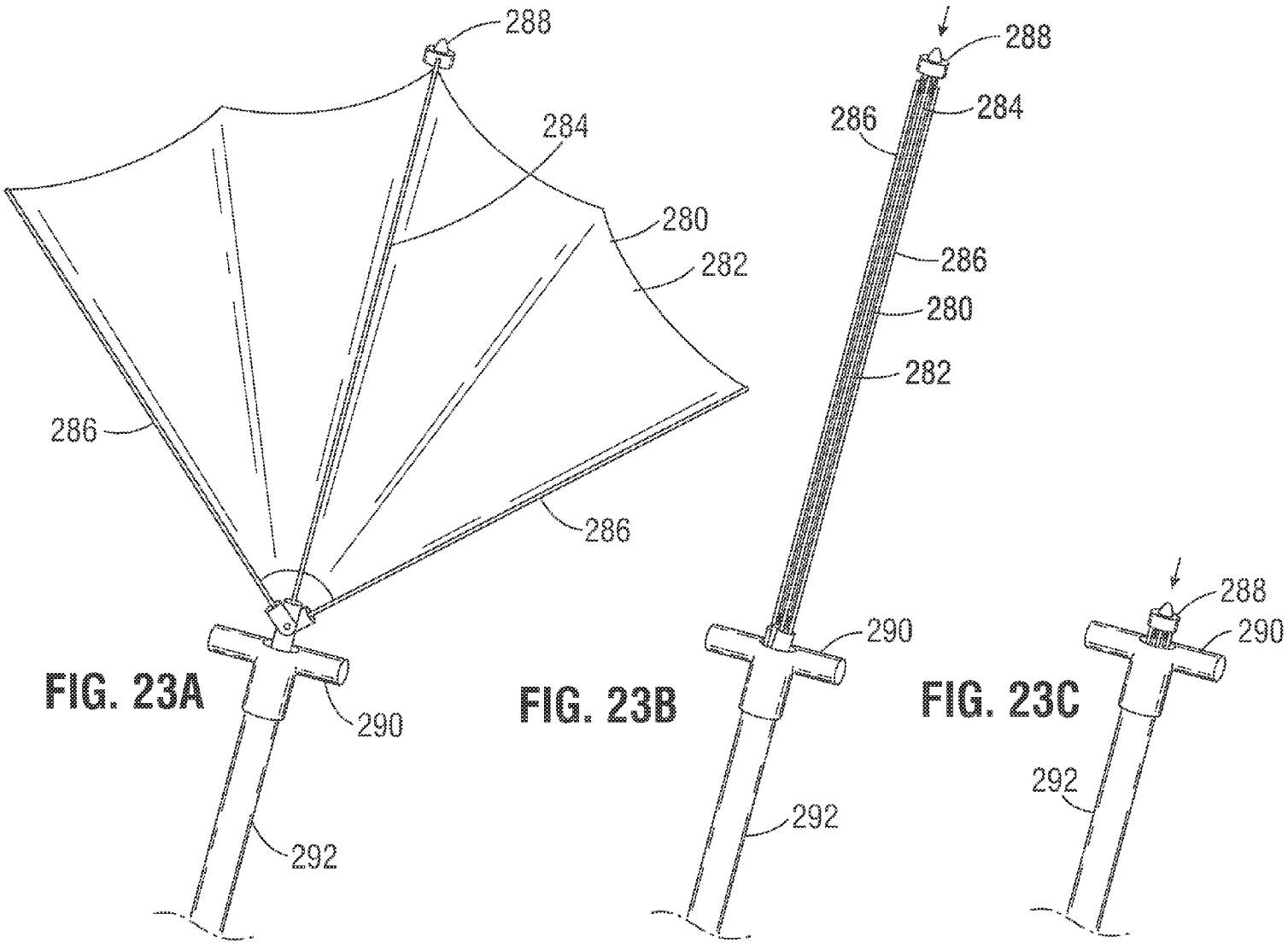
FIGS. 23A-23C depict perspective views, in deployed, stowing, and stowed configurations, of a sail assembly according to an embodiment of the invention.

Additional sail assemblies are also within the scope of the invention. One such embodiment is the fan-shaped sail assembly 280 depicted in FIGS. 23A-23C. As depicted in FIG. 23A, a sail assembly 280 is deployed to create a fan-shaped sail 282 supported by a central mast 284 and outside masts 286, with the central mast 284 extending distally and substantially in alignment with the paddle shaft 292, and the outside masts 286 angled away from the central mast 284 at angles of about 45 degrees Other angles include angles between 90 degrees and 30 degrees. To stow the sail assembly 280, the operator folds the outside masts 286 in against the central mast 284, as depicted in FIGS. 23B-23C, and then presses inwardly against the top cap 288 to slidingly the sail assembly 280 through the paddle handle 290 and into the paddle shaft 292.

Figure 24B:
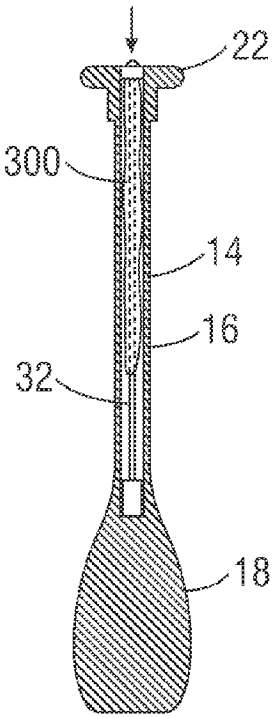
FIGS. 24A-24B depict side (cross-sectional) views in deployed and stowed configuration, respectively, of a paddle according to a further embodiment of the invention.
Figure 24A:
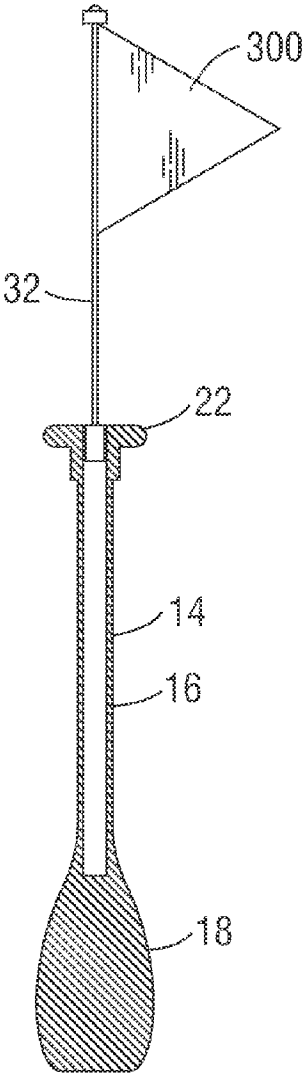

FIGS. 24A-24B depict a paddle 14 according to a further embodiment of the invention, wherein the paddle shaft 16 has a mast 32 slidingly received therein and having a signal or warning/safety flag 300 on the distal end thereof. The mast may have a length from 12 inches to 6 feet or more, and thus provides the user the ability to raise the signal/warning flag to a height where it can be easily seen. The signal or warning flag 300 may be brightly colored, and/or may include other information (e.g., dive flag markings, etc.) to signal a particular activity or danger or request for assistance. With the mast 32 and signal flag 300 in the stowed configuration, as depicted in FIG. 24B, the SUP paddle may look like a regular SUP paddle.

Note that the signal flag of FIGS. 24A-24B may be used in addition to a sail as disclosed previously, with the signal flag being removably disposed and/or hidden from view until needed (so that a user can sail without displaying the signal flag, but when necessary can deploy the signal flag (e.g., by adding the signal/warning flag to the mast and/or unrolling or otherwise revealing the signal flag from a hidden position on the sail assembly).

Figure 25B:
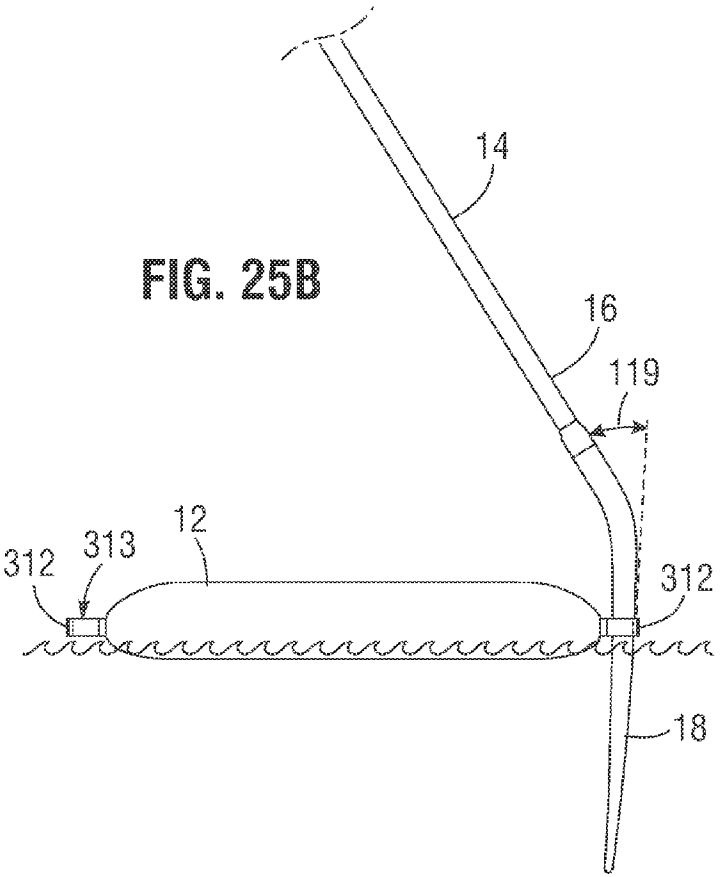
FIGS. 25A-25B depict perspective and rear views, respectively, of a system according to the invention having straps for holding the paddle blade adjacent the SUP paddle board.
Figure 25A:
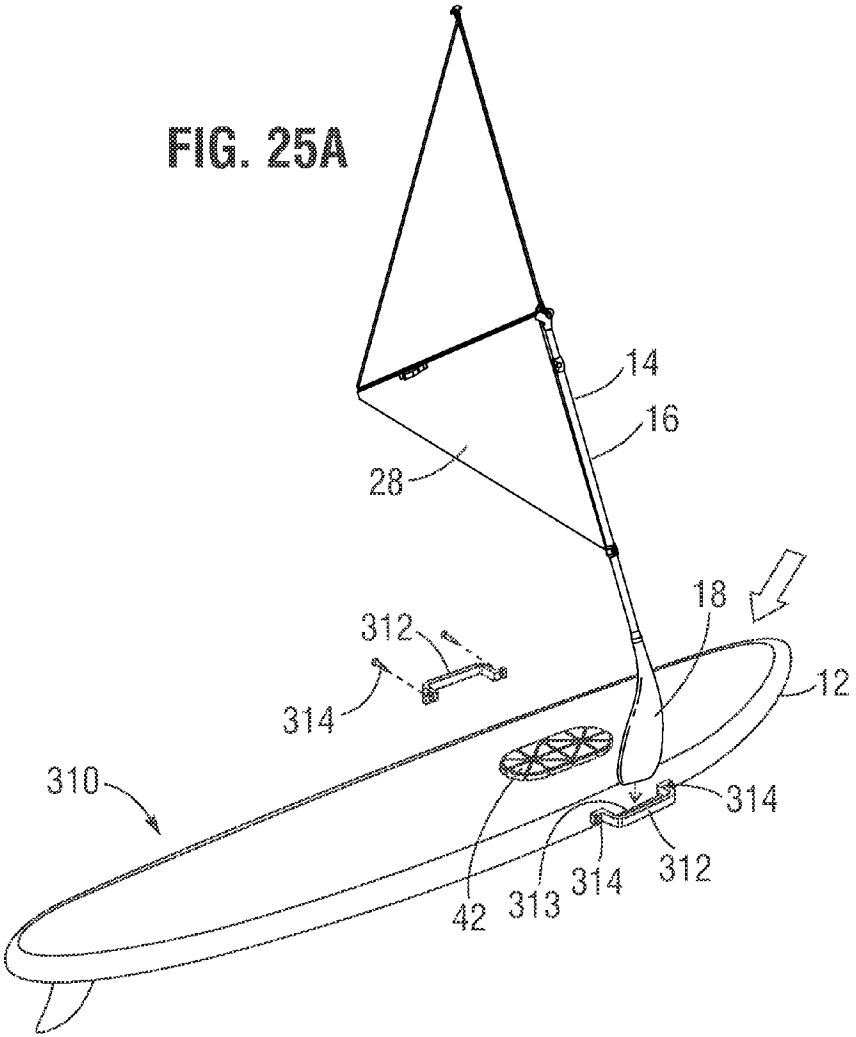

FIGS. 25A-25B depict a system 310 according to the invention where a SUP paddle board 12 has straps 312 on either side thereof which are sized to receive the paddle blade 18 therein in order to hold the paddle blade 18 against the side of the board 12. The user can place the paddle blade 18 into the strap opening 313 for sailing, and then lift the paddle blade out of the strap opening as desired for paddling and/or changing sailing configuration. The strap opening 313 preferably has a length just greater than the width of the paddle blade 18. For example, for paddles with blades between 7 and 10 inches in width, strap openings may have lengths between 8 and 12 inches. The strap 312 may be secured to the sides of the SUP paddle board via screws 314 or other conventional means, such as glue, etc. As depicted in FIGS. 25A-25B, the operator can drop the blade 18 into the strap 312 and effectively use the paddle blade 18 as a type of dagger board/keel/rudder to improve pointing of the board 12 in the desired direction. Note that the strap may be formed from a flexible material such as canvas strapping, or formed from a more rigid material such as plastic. The strap 312 may be positioned at various positions along the length of the board, but may preferably be positioned just forward of the user. Because a user often stands at the middle position along the length of the board, the strap 312 may preferably be positioned just forward of the user, e.g., about 1-3 feet forward of the halfway point along the length of the board.

Note that instead of enclosed straps as depicted in FIGS. 25A-25B, open-ended structures (such as a small peg or open-ended bracket) could be used to help hold the padded in place along the board. For example, an L- or U-shaped bracket could extend out from and parallel (lengthwise) with the board, with the open-end of the L- or U-shaped bracket facing forward with respect to the board. A user could thus position the blade at least partially within the bracket, with the bracket helping to hold the paddle against the board and preventing unwanted backward movement of the paddle blade with respect to the board. Similarly, a relatively small peg (e.g., ½ to 4 inches in length, or 1 to 3 inches in length) could extend substantially sideways (and/or angled outward but also forward with respect to the board) from the board. The user could position the paddle blade in contact with and on the forward side of the peg, with the bracket helping to hold the paddle against the board and preventing unwanted backward movement of the paddle blade with respect to the board. Note that all such structures (pegs, L- or U-shaped brackets, straps, etc.) could be configured to help hold the blade against the board while also permitting the user to rotate the blade angle with respect to the oncoming water flow (created by the forward movement of the board), with the change in blade angle used to enhance the trackability and/or to steer the board as desired by the user. For example, a user could angle the leading edge of the blade outward with respect to the board, or rotate the trailing edge of the blade outward with respect to the board, to effectuate desired tracking and steering.

The configuration depicted in FIG. 25B may be particularly useful for use in a beam reach and/or upwind sailing (e.g., close hauled). For example, the user could position the blade 18 in the water on the downwind/leeward side of the board (which may include positioning the shaft in a strap such as depicted in FIG. 25B) for tracking/steering, with the paddle shaft/sail mast extending backwards (with respect to the length of the board) and across to the windward side of the board (possibly with the boom pointing generally downward as opposed to upward) to capture/redirect the oncoming wind. Note that the sail 28 as depicted in FIG. 25A may be positioned with respect to the blade so that the sail presents a plane that is substantially parallel to the plane of the paddle blade. With the paddle shaft/sail mast (and thus the sail) thus positioned toward the rear and windward side of the board, the user could adjust the sail angle of attack with respect to the wind (e.g., by pulling on the boom handle 44 depicted in FIG. 1 and/or adjusting the angle of the paddle shaft and/or adjusting the upper shaft portion with respect to the lower shaft portion, etc.) to effectuate forward movement of the paddle board 12.

Figure 26B:
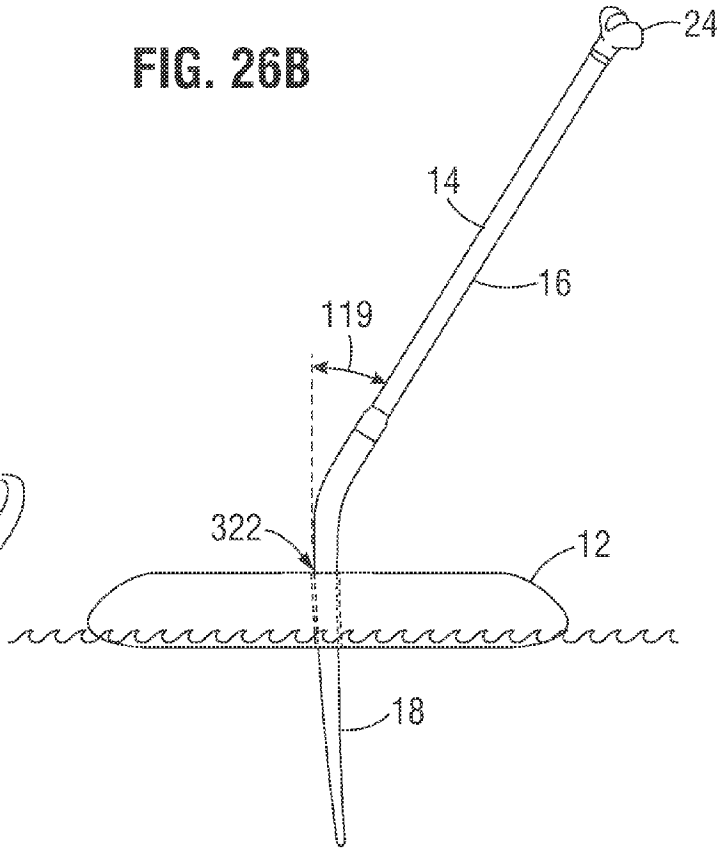
FIGS. 26A-26B depict perspective and front views, respectively, of a system according to the invention having a slot in the SUP paddle board for receiving a blade of the SUP paddle.
Figure 26A:
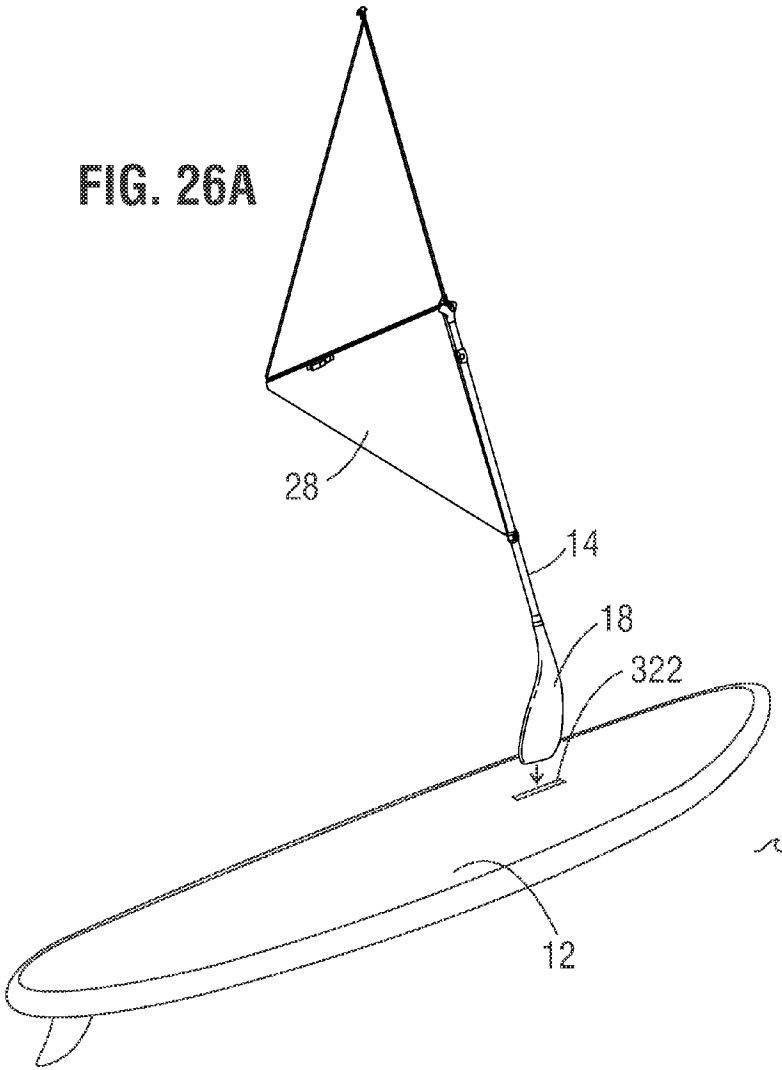

FIGS. 26A-26B depict perspective and front views, respectively, of a system 320 where a SUP board 12 has a slot 322 passing therethrough, which may be generally centered on the board 12 and toward the front thereof. The slot 322 preferably has a length 324 greater than the width of the paddle blade (e.g., a length between 8 and 14 inches), and a width 326 sufficient to freely receive the paddle blade 18 and which may allow some movement of the blade 18 in side-to-side rotation fashion in order to permit the user to orient the mast/paddle shaft to a desired angle from the vertical with respect to the SUP board. For example, the width 326 may be between ½ inch to 2 inches. As depicted in FIGS. 26A-26B, the operator can drop the blade 18 into the slot 322 and effectively use the paddle blade 18 as a type of dagger board/keel/rudder to improve pointing of the board in the desired direction.

Figure 27:
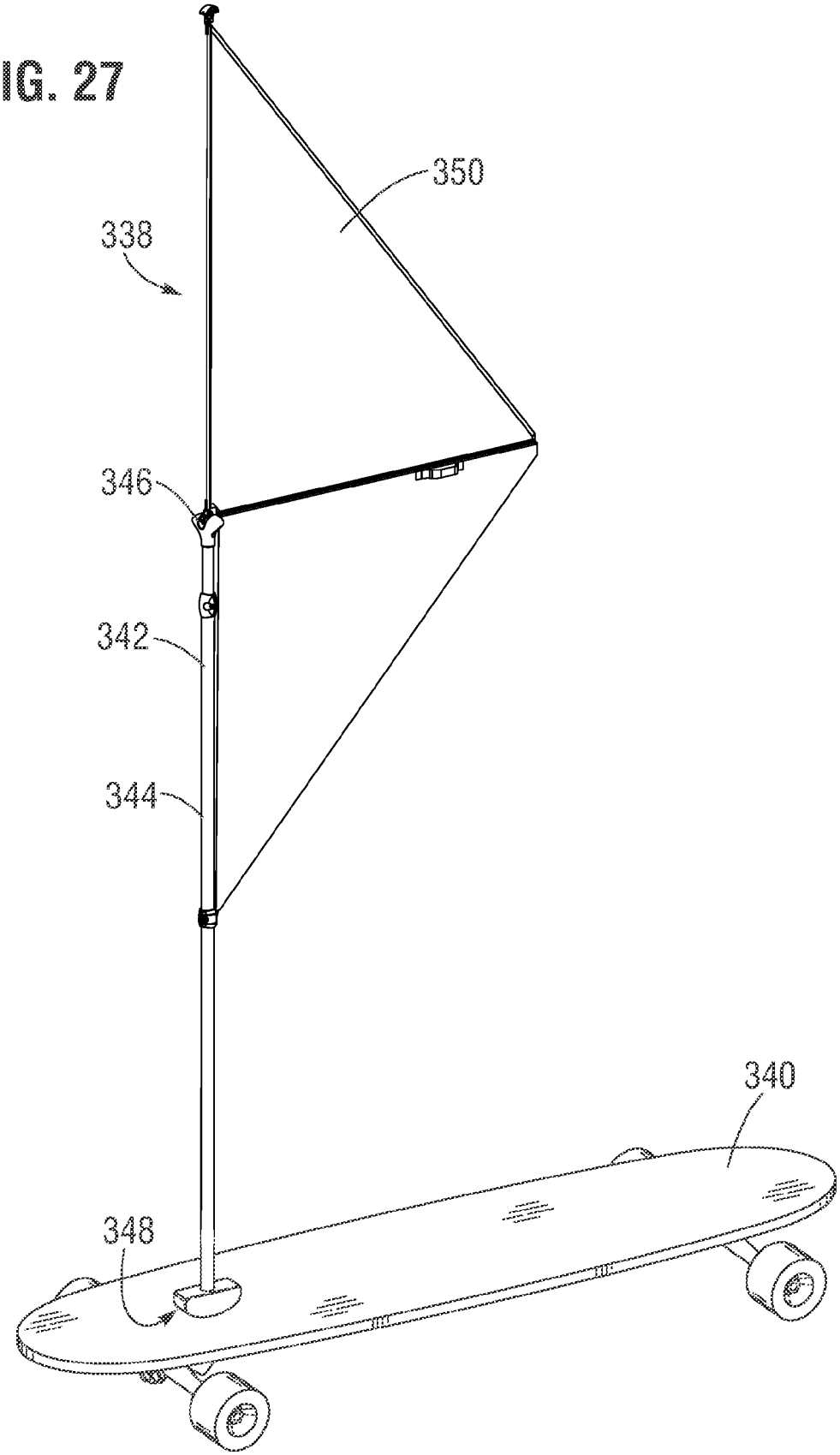
FIG. 27 depicts a perspective view of a system for propelling an operator using a skateboard and a land paddle having a sail therein.

Referring now to FIG. 27, a system 338 according to the invention comprises a skateboard 340 and a so-called land paddle 342. The land paddle 342 comprises a shaft 344, a handle 346, and a padded lower end 348 for engaging the ground to pole the operator along the road or other ground surface. The device is thus similar to the water paddle disclosed above, but the paddle blade has been replaced with a padded lower end 348. In such an embodiment, the user can deploy the sail assembly 350 by sliding it out of the handle 346, and place the padded lower end 348 onto the skateboard upper surface as shown, and let the wind drive the operator and skateboard along. The sail for the land paddle may have dimensions and structure similar to, or identical to, that previously disclosed herein for the sail water paddle, and the land paddle 342 may include structures such as the upper shaft, lower shaft, shaft lock, and downhaul lock disclosed previously for the water paddle.

While the invention has been described in its preferred embodiments, it is to be understood that the words which have been used are words of description and not of limitation. Therefore, changes may be made within the appended claims without departing from the true scope of the invention.

What is claimed is:

1. A paddle, comprising:

an elongated paddle shaft having an internal lumen, a proximal end, a distal end, and a distal opening at the distal end, wherein the distal opening leads to the internal lumen;

a paddle blade secured to the proximal end of the paddle shaft;

a sail assembly comprising a sail and a collapsible support structure, wherein the sail assembly comprises a stowed configuration and a deployed configuration, wherein in the stowed configuration the support structure and sail assembly are slidingly stowed within the paddle shaft internal lumen, in the deployed configuration the support structure and sail extend outwardly from the paddle shaft distal end, wherein the collapsible support structure comprises a mast and a boom, wherein the mast comprises a mast proximal end and a mast distal end and the boom comprises a boom proximal end and a boom distal end, and wherein the boom proximal end is hingedly secured to the mast at a boom attachment point, and wherein in the stowed configuration the mast, boom, and sail are slidingly positioned within the paddle shaft internal lumen with the boom substantially parallel to the mast, wherein in the deployed configuration the sail, mast, and boom are positioned outside of the paddle shaft internal lumen with the boom substantially non-parallel to the mast, wherein the sail assembly transforms from the stowed configuration to the deployed configuration by hingedly rotating the boom to a substantially non-parallel orientation from the mast.

2. The paddle of claim 1, wherein the boom attachment point is positioned at a proximal end of the mast and at a distal end of the paddle shaft when the sail assembly is in the deployed configuration.

3. The paddle of claim 1, wherein the mast is positioned substantially in longitudinal alignment with the paddle shaft when the sail assembly is in the deployed configuration.

4. The paddle of claim 3, wherein the boom is positioned substantially perpendicular to the mast when the sail assembly is in the deployed configuration.

5. The paddle of claim 4, wherein the paddle shaft comprises a lower shaft portion to which the paddle blade is secured, an upper shaft portion, and a shaft locking mechanism, wherein the lower shaft portion and upper shaft portion are telescopically and rotatably movable with respect to each other when the shaft locking mechanism is locked, and the lower shaft portion and upper shaft portion are telescopically locked with respect to each other when the shaft locking mechanism is locked.

6. The paddle of claim 5, wherein the lower shaft portion and upper shaft portion are rotatably locked with respect to each other when the shaft locking mechanism is locked.

7. The paddle of claim 4, wherein the sail further comprises a sail strap secured to the boom at a position closer to the distal end thereof than to the proximal end thereof, wherein the sail strap is sized and configured to permit a user to pass a hand therethrough to thereby grasp the sail strap.

8. The paddle of claim 4, further comprising an O-ring at or adjacent a distal end of the mast, wherein the O-ring is configured to seal the shaft distal opening when the mast, boom, and sail are slidingly positioned within the paddle shaft internal lumen in the stowed configuration.

9. A method of traveling across the water surface on a paddle board, comprising:

placing a paddle board in the water;

holding a paddle in a hand of a user, wherein the paddle comprises a paddle shaft having a proximal and a distal end, wherein a paddle blade is secured to the proximal end and a sail assembly comprising a sail and a mast and an elongated sail support is slidingly disposed within the paddle shaft, wherein the user holds the paddle by the paddle shaft;

standing on the upper surface of the paddle board;

paddling the board by placing the paddle blade in the water and pushing against the water via the paddle blade;

telescopically and slidingly extending the sail assembly out of the paddle shaft via the distal end of the shaft;

unfolding the sail assembly to a deployed configuration wherein the elongated sail support is non-parallel to the mast;

securing the sail assembly in the deployed configuration;

sailing the paddle board by positioning the paddle and deployed sail assembly in front of the user with the deployed sail assembly above the board to capture and/or redirect the wind to effectuate movement of the paddle board.

10. The method of claim 9, after sailing the paddle board, the further steps of:

unsecuring the sail assembly from the deployed configuration;

folding the sail assembly from the deployed configuration; and slidingly and telescopically retracting the sail assembly into the paddle shaft via the distal end of the shaft.

11. The method of claim 9, wherein sailing the paddle board comprises placing the paddle blade onto the top surface of the paddle board.

12. A method of traveling across the water surface on a paddle board, comprising:

placing a paddle board in the water;

holding a paddle in a hand of a user, wherein the paddle comprises a paddle shaft having a proximal and a distal end, wherein a paddle blade is secured to the proximal end and a sail assembly is slidingly disposed within the paddle shaft, wherein the user holds the paddle by the paddle shaft;

standing on the upper surface of the paddle board;

paddling the board by placing the paddle blade in the water and pushing against the water via the paddle blade;

telescopically and slidingly extending the sail assembly out of the paddle shaft via the distal end of the shaft;

unfolding the sail assembly to a deployed configuration;

securing the sail assembly in the deployed configuration;

sailing the paddle board by positioning the paddle and deployed sail assembly with the deployed sail assembly above the board to capture and/or redirect the wind to effectuate movement of the paddle board;

wherein sailing the paddle board comprises placing the paddle blade into the water along a side of the paddle board with the blade substantially parallel to the side of the paddle board.

13. A method of traveling across the water surface on a paddle board, comprising:

placing a paddle board in the water;

holding a paddle in a hand of a user, wherein the paddle comprises a paddle shaft having a proximal and a distal end, wherein a paddle blade is secured to the proximal end and a sail assembly is slidingly disposed within the paddle shaft, wherein the user holds the paddle by the paddle shaft;

standing on the upper surface of the paddle board;

paddling the board by placing the paddle blade in the water and pushing against the water via the paddle blade;

telescopically and slidingly extending the sail assembly out of the paddle shaft via the distal end of the shaft;

unfolding the sail assembly to a deployed configuration;

securing the sail assembly in the deployed configuration;

sailing the paddle board by positioning the paddle and deployed sail assembly with the deployed sail assembly above the board to capture and/or redirect the wind to effectuate movement of the paddle board;

wherein sailing the paddle board comprises steering the paddle board by placing the paddle blade into the water along a side of the paddle board with the blade angled from the side of the paddle board.

14. The method of claim 9, further comprising:

steering the paddle board by shifting the deployed sail assembly to the right and/or left side of the paddle board.

15. A paddle, comprising:

an elongated paddle shaft having an internal lumen, a proximal end, a distal end, and a distal opening at the distal end, wherein the distal opening leads to the internal lumen;

a paddle blade secured to the proximal end of the paddle shaft;

a sail assembly comprising a sail and a collapsible support structure, wherein the sail assembly comprises a stowed configuration and a deployed configuration, wherein in the stowed configuration the support structure and sail assembly are slidingly stowed within the paddle shaft internal lumen, in the deployed configuration the support structure and sail extend outwardly from the paddle shaft distal end, wherein the collapsible support structure comprises a primary mast and an elongated sail support, wherein in the stowed configuration the primary mast, elongated sail support, and sail are slidingly positioned within the paddle shaft internal lumen with the elongated sail support substantially parallel to the primary mast, wherein in the deployed configuration the sail, primary mast, and elongated sail support are positioned outside of the paddle shaft internal lumen with the elongated sail support substantially non-parallel to the mast, wherein the sail assembly transforms from the stowed configuration to the deployed configuration by telescopically and slidingly extending from the distal opening of the elongated paddle shaft and rotating the elongated sail support to a substantially non-parallel orientation from the primary mast.

16. The paddle of claim 15, wherein the sail comprises a sleeve, and the elongated sail support is positioned within the sleeve.

17. The paddle of claim 16, wherein in the deployed configuration the primary mast is longitudinally aligned with the paddle shaft and the elongated sail support is positioned at an angle between 60 and 120 degrees from the primary mast.

18. The paddle of claim 16, wherein the elongated sail support in the deployed configuration is positioned at an angle between 80 and 100 degrees from the mast.

19. The paddle of claim 15, wherein the elongated sail support is a first outside mast, and the collapsible support structure further comprises a second outside mast, wherein in the stowed configuration the first outside mast and second outside mast are both slidingly stowed within the paddle shaft and substantially parallel to the primary mast, wherein in the deployed configuration the first outside mast angles away from the primary mast at a first side of the primary mast, and in the deployed configuration the second outside mast angles away from the primary mast at a second side of the primary mast, wherein the first side of the primary mast is opposite to the second side of the primary mast.

20. The paddle of claim 19, wherein in the deployed configuration the first outside mast angles away from the primary mast at a first side of the primary mast at an angle between 30 and 90 degrees, and in the deployed configuration the second outside mast angles away from the primary mast at a second side of the primary mast at an angle between 30 and 90 degrees.

* * * * *